US007931039B2

(12) United States Patent
Yang

(10) Patent No.: US 7,931,039 B2
(45) Date of Patent: Apr. 26, 2011

(54) FOLDABLE FRAME STRUCTURE

(76) Inventor: Wei Hen Yang, Taipei (TW)

( * ) Notice: Subject to any disclaimer, the term of this patent is extended or adjusted under 35 U.S.C. 154(b) by 0 days.

(21) Appl. No.: 12/569,399

(22) Filed: Sep. 29, 2009

(65) Prior Publication Data

US 2010/0089429 A1 Apr. 15, 2010

Related U.S. Application Data

(63) Continuation of application No. 11/790,466, filed on Apr. 25, 2007, now abandoned.

(30) Foreign Application Priority Data

Jan. 12, 2007 (TW) ..... 96101189 A

(51) Int. Cl.
*E04H 15/40* (2006.01)
*E04H 15/48* (2006.01)

(52) U.S. Cl. ..... 135/126; 135/136; 135/143

(58) Field of Classification Search ..... 135/125, 135/126, 128, 143, 119, 120.3, 124, 136; 446/478

See application file for complete search history.

(56) References Cited

U.S. PATENT DOCUMENTS

| | | | | |
|---|---|---|---|---|
| 3,990,463 | A * | 11/1976 | Norman | 135/126 |
| 5,038,812 | A * | 8/1991 | Norman | 135/126 |
| 5,816,278 | A * | 10/1998 | Kim | 135/126 |
| 6,328,049 | B1 * | 12/2001 | Kim | 135/126 |
| 7,798,163 | B2 * | 9/2010 | Yang | 135/126 |
| 2007/0144571 | A1 * | 6/2007 | Wu et al. | 135/126 |
| 2008/0169015 | A1 * | 7/2008 | Yang | 135/126 |

* cited by examiner

*Primary Examiner* — David Dunn
*Assistant Examiner* — Danielle Jackson

(57) ABSTRACT

The present invention provides a foldable frame structure, which comprises a limit portion, a canopy portion and a frame body. The limit portion encloses an area with a predetermined figure. The canopy portion is connected with the limit portion. The frame body is connected with the canopy portion for lifting the canopy portion from the limit portion. The frame body further comprises a plurality of cambered areas, a plurality of first overlapping ends, a plurality of second overlapping ends and a plurality of contacting ends. The plurality of contacting ends press against the limit portion respectively. The plurality of first overlapping ends are aligned along an extended direction. Each of the cambered areas is simultaneously connected with another cambered area at the first overlapping end and connected with yet another cambered area at the second overlapping end. Thus, the foldable frame structure can be collapsed for storage by making the plurality of cambered areas come into close contact with one another successively.

5 Claims, 33 Drawing Sheets

FOLDABLE FRAME STRUCTURE

This application is a continued application (CA) of U.S. application Ser. No. 11/790,466 filed on Apr. 25, 2007 now abandoned which is pending and is claiming the benefit of Taiwan application serial no. 096101189, filed on Jan. 12, 2007.

BACKGROUND OF INVENTION

1. Field of the Invention

The present invention relates to a frame structure, and more particularly, to a frame structure that can be folded for storage and expansion.

2. Description of the Prior Art

Structure is one of the most fundamental elements upon which the existence of a material form, such as a house or a machine is based. Without structure, the material form cannot be maintained, and if the material form cannot be maintained, it cannot be clearly expressed. Therefore, without the material structure, the organic and inorganic materials cannot be combined together. The strength that resists force and preserves the perpetuity of the form of an object is termed structure. In human technical environment, structure is a material pattern that preserves the functions of objects.

The technical mission for the structure to shoulder is to not only control the weight of an object itself, but also bear an external load (force). Such a mission is mechanically termed as bearing. As a structure system for upholding a form is subject to the load conditions and strictly dominated by the rules of natural force flows, it cannot be achieved under an arbitrary and free design. For instance, the form and space of a tent are resulted from considerations related to the bearing mechanism.

Structure is the foremost and the only tool for a tent to present the form and space thereof. In virtue of this function, structure is regarded as a basis of the human material environment. Thus, among various considerations in the design of a tent, structure is the primary factor to be considered. As the structure can be entirely hidden within a tent and may substantially appear as the form of a tent itself, such adaptability of the structural design of a tent permits a designer to embody his creative ideas through combining the forms, materials and forces. Hence, for increasing the utility rate and market share of tent products, how to actualize tents with improved structure and enhanced functions to meet the consumers' need has become the primary challenge for the manufactures to deal with.

SUMMARY OF INVENTION

The present invention has been accomplished under these circumstances in view. It is one objective of the present invention to provide a foldable frame structure, which implements a single frame structure to form an array of a plurality of cambered areas and a plurality of overlapping ends so as to enable the foldable frame structure to be promptly folded for storage and expansion.

It is another objective of the present invention to provide a foldable frame structure, wherein a frame structure is provided in a canopy portion for upholding the canopy portion so as to provide the canopy portion with a ventilative accommodating space therein.

It is yet another objective of the present invention to provide a foldable frame structure, wherein the canopy portion can be shaped into a cambered figure by the frame structure, so that a three-dimensional and artistic appearance of the canopy portion can be achieved.

It is a yet further objective of the present invention to provide a foldable frame structure, wherein the canopy portion is upheld by the frame structure and has the accommodating space formed therein, so that the objective of accommodating people in the canopy portion can be achieved.

In order to achieve the aforementioned objectives, the present invention discloses an embodiment of foldable frame structure, comprising:

a limit portion, enclosing an area having a predetermined figure;

a canopy portion, connected with the limit portion; and a frame body, which is connected with the canopy portion for lifting the canopy portion from the limit portion and comprises a plurality of cambered areas, a plurality of first overlapping ends, a plurality of second overlapping ends, and a plurality of contacting ends; wherein the plurality of contacting ends press against the limit portion respectively; the plurality of first overlapping ends are aligned along an extended direction; and each of the cambered areas is simultaneously connected with another cambered area at the first overlapping end and connected with yet another cambered area at the second overlapping end, wherein the foldable frame structure can be collapsed for storage by making the plurality of cambered areas pile mutually.

In order to achieve the aforementioned objectives, the present invention discloses another embodiment of foldable frame structure, comprising:

a limit portion, enclosing an area having a predetermined figure;

a canopy portion, connected with the limit portion; and a first frame enclosing at least a cambered area, which comprises at least two contacting ends and is connected with the canopy portion for lifting the canopy portion from the limit portion while the first connecting ends press against the limit portion; and a second frame that comprises at least two contacting ends, which press against the limit portion, wherein when the second frame and the first frame are stacked together, a plurality of cambered areas, a plurality of first overlapping ends, and a plurality of second overlapping ends can be formed; wherein the plurality of first overlapping ends are aligned along an extended direction; and each of the cambered areas is simultaneously connected with another cambered area at the first overlapping end and connected with yet another cambered area at the second overlapping end, in which the foldable frame structure can be collapsed for storage by making the plurality of cambered areas pile mutually.

Preferably, the present invention also discloses yet another embodiment of foldable frame structure, comprising:

a limit portion, enclosing an area having a predetermined figure;

a canopy portion, connected with the limit portion; and a plurality of frame bodies, which are positioned inside the canopy portion in a predetermined array and are connected with the canopy portion, wherein each said frame body comprises at least two cambered areas, at least one overlapping end, and two contacting ends, in which the two contacting ends press against the limit portion respectively so as to make the overlapping end comes into being the substantial apogee and distant from the limit portion with a height;

wherein because the plurality of frame bodies are positioned inside the canopy portion in the predetermined array, the plurality of overlapping ends are aligned along an extended direction, and by making the frame bodies come into close contact with one another successively and making the cambered areas come into close contact with one another successively, the frame can be collapsed for storage.

Preferably, the present invention discloses yet a further embodiment of foldable frame structure, comprising:

a limit portion, enclosing an area having a predetermined figure;

a canopy portion, connected with the limit portion; and at least one frame body, wherein the frame body comprises a plurality of cambered areas settled inside the canopy portion as a radial array, wherein each said cambered area is connected with another cambered area at a first overlapping end, while connected with the limit portion at a contacting end so that a pinnacle can come into being the substantial apogee and distant from the limit portion with a height, and by making the plurality of cambered areas come into close contact with one another successively, the foldable frame structure can be collapsed for storage.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION

Figure 1A:
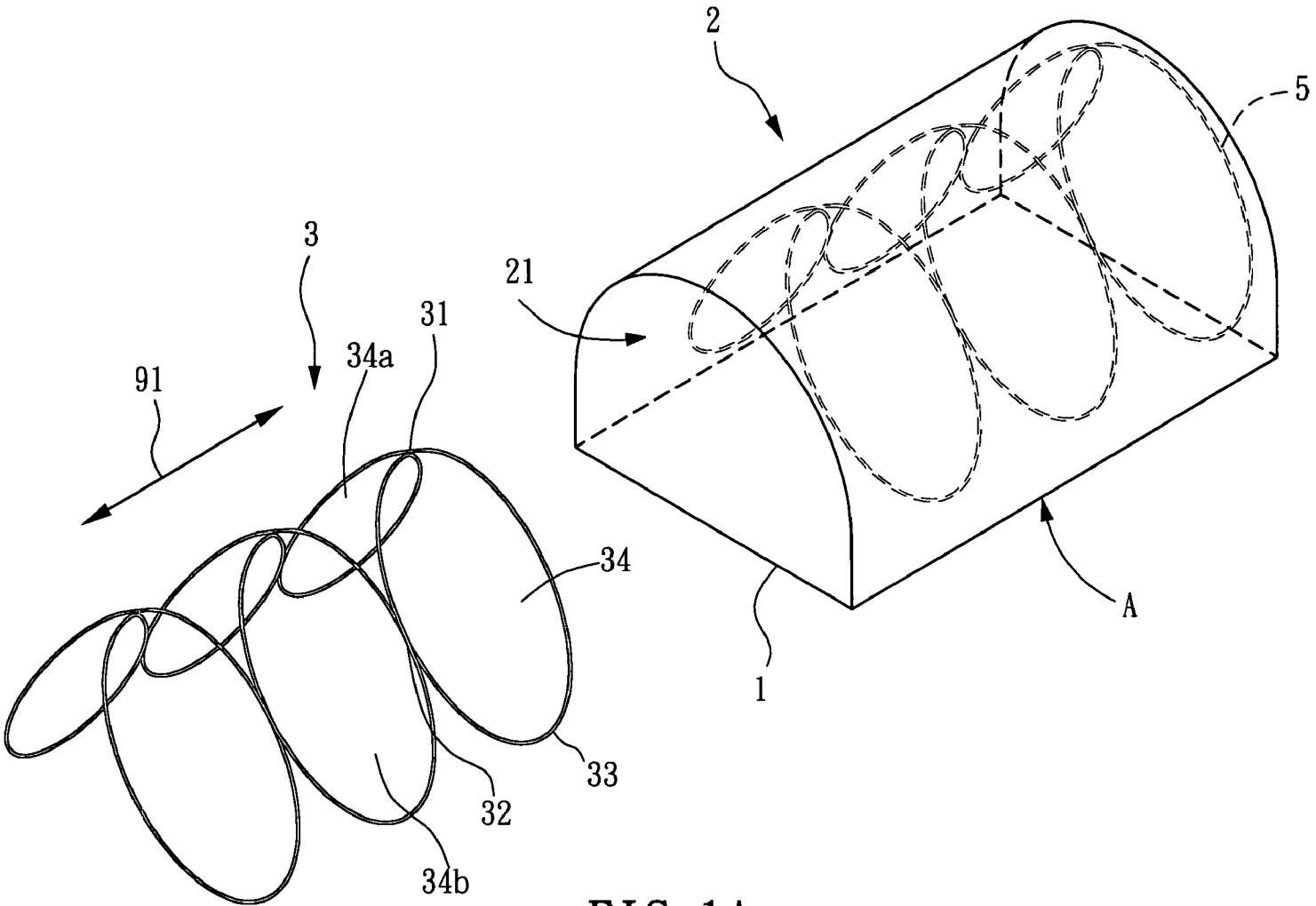
FIG. 1A is an exploded view of the disclosed foldable frame structure according to a first preferred embodiment of the present invention.
Figure 1B:
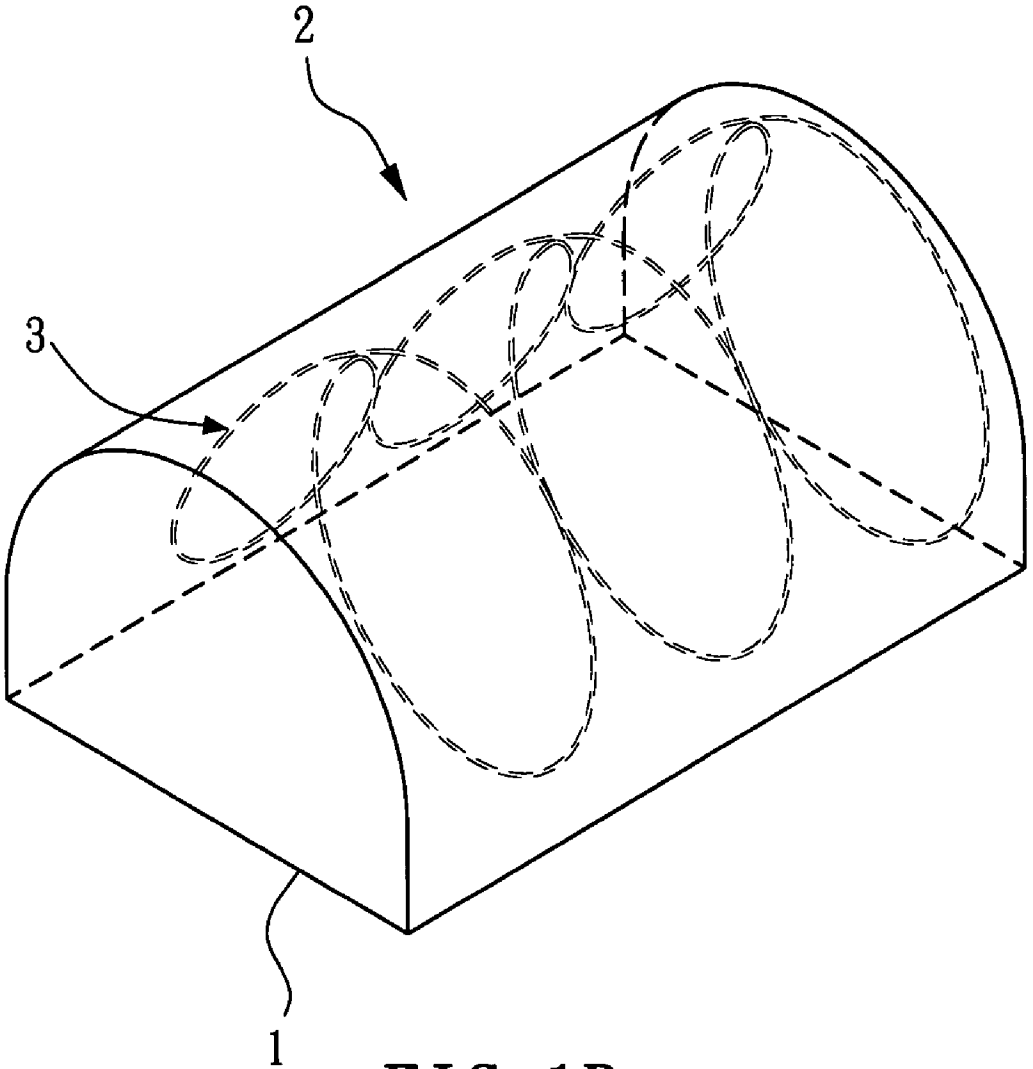
FIG. 1B is an assembly drawing of the disclosed foldable frame structure according to the first preferred embodiment of the present invention.
Figure 1C:
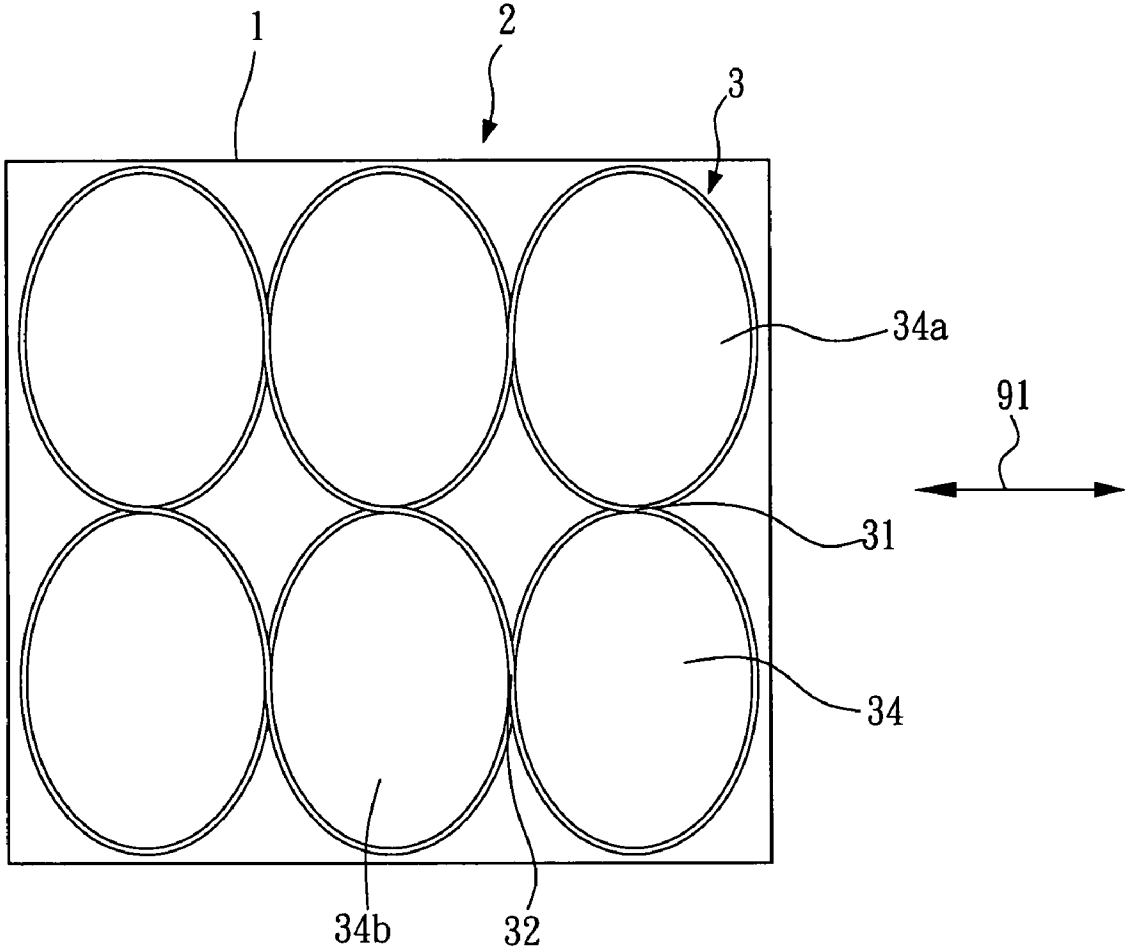
FIG. 1C is a front view showing the structure of the disclosed foldable frame structure according to the first preferred embodiment of the present invention.
Figure 1D:
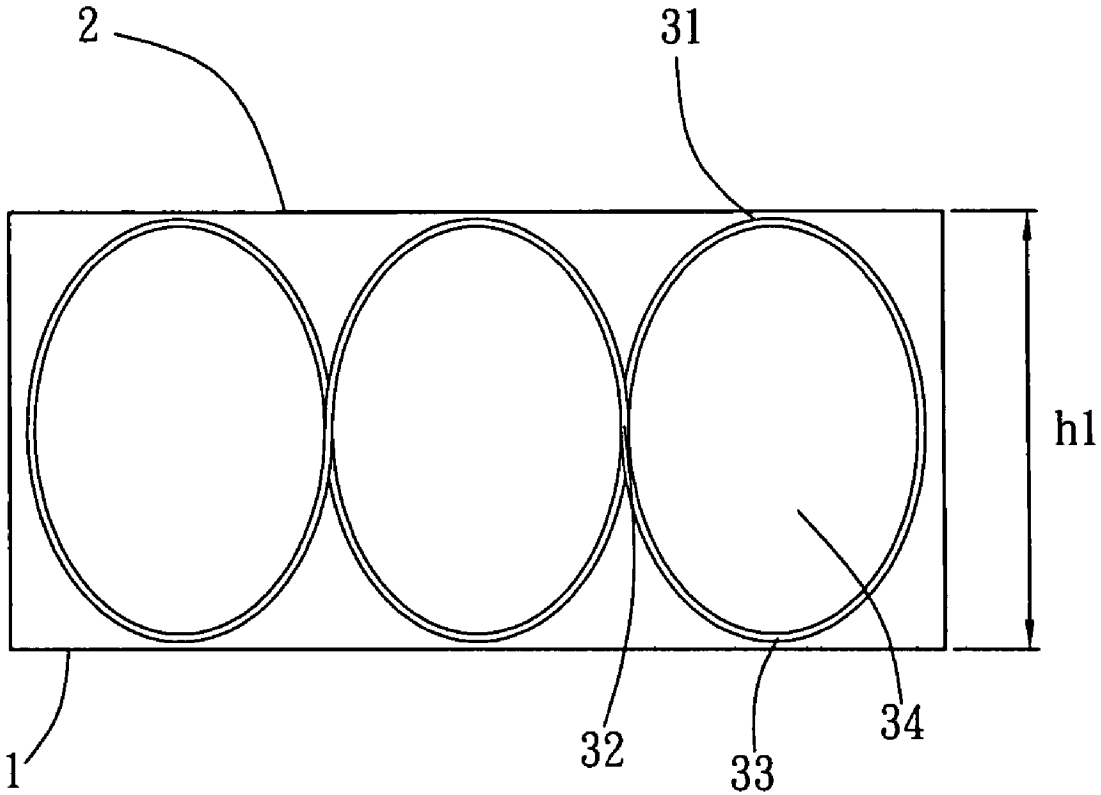
FIG. 1D is a top view showing the structure of the disclosed foldable frame structure according to the first preferred embodiment of the present invention.

Please refer to FIGS. 1A through 1D for the exploded view, assembly drawing, front view and top view of the disclosed foldable frame structure according to the first preferred embodiment of the present invention. The foldable frame structure of the present invention comprises a limit portion 1, a canopy portion 2 and a frame body 3. The limit portion 1 is provided to enclose and define an area "A" having a predetermined figure. In the present embodiment, the predetermined figure may be a polygonal figure, or more desirable, may be a rectangular figure. Certainly, the predetermined figure may also be a hexagonal figure or an approximately elliptical figure. The limit portion 1 may be substantially a bottom pad that can be placed at a plane (not shown in the figures). Alternatively, the limit portion 1 can be merely composed of a rope or an elastic belt that circles round the periphery of the canopy portion 2. Thus, the structure in which the canopy portion 2 bulges from the area A can be achieved by merely pulling the limit portion 1. As it will be understood by one of ordinary skill in the art that numerous variations of the structures and figures will be possible to the disclosed embodiment without going outside the scope of the invention, the variations of the structures and figures will not be discussed in great details herein.

The canopy portion 2 is in connection with the limit portion 1. In the present embodiment, the canopy portion 2 is sewed to the limit portion 1. Alternatively, the canopy portion 2 and the limit portion 1 may be connected by a zip-positioning component provided therebetween. Further, the canopy portion 2 comprises at least one opening 21, which permits a user (not shown in the figures) to pass therethrough and enter the interior of the canopy portion 2. According to the present embodiment, the opening 21 is arranged at one side of the canopy portion 2. Certainly, the opening 21 can also be established on the canopy portion 2 directly and need not be discussed at any length herein. The canopy portion 2 is further connected to the frame body 3, and the canopy portion 2 can be lifted from the limit portion 1 and thus forming a sleeping bag, a tent, a mosquito curtain or a ball house.

The frame body 3 further comprises a plurality of cambered areas 34 and a plurality of first overlapping ends 31, a plurality of second overlapping ends 32, and a plurality of contacting ends 33. Each of the plurality of contacting ends 33 presses against the limit portion 1 respectively. The plurality of first overlapping ends 31 are aligned along an extended direction 91. Each of the cambered areas 34 is simultaneously connected with another cambered area 34*a* at the first overlapping end 31, and connected with yet another cambered area 34*b* at the second overlapping end 32. In the present embodiment, the frame body 3 may be made integrally or by combining several segments, and is made of an elastic material. Preferably, the frame body 3 contains an odd number of 8-shaped parts that are ranked along the extended direction 91. In virtue of the relative positional limit between the canopy portion 2 and the limit portion 1, and because the plurality of contacting ends 33 press against the limit portion 1 respectively, the plurality of first overlapping ends 31 can come into being the substantial apogees respectively and distant from the limit portion 1 with a height h1.

Figure 1E:
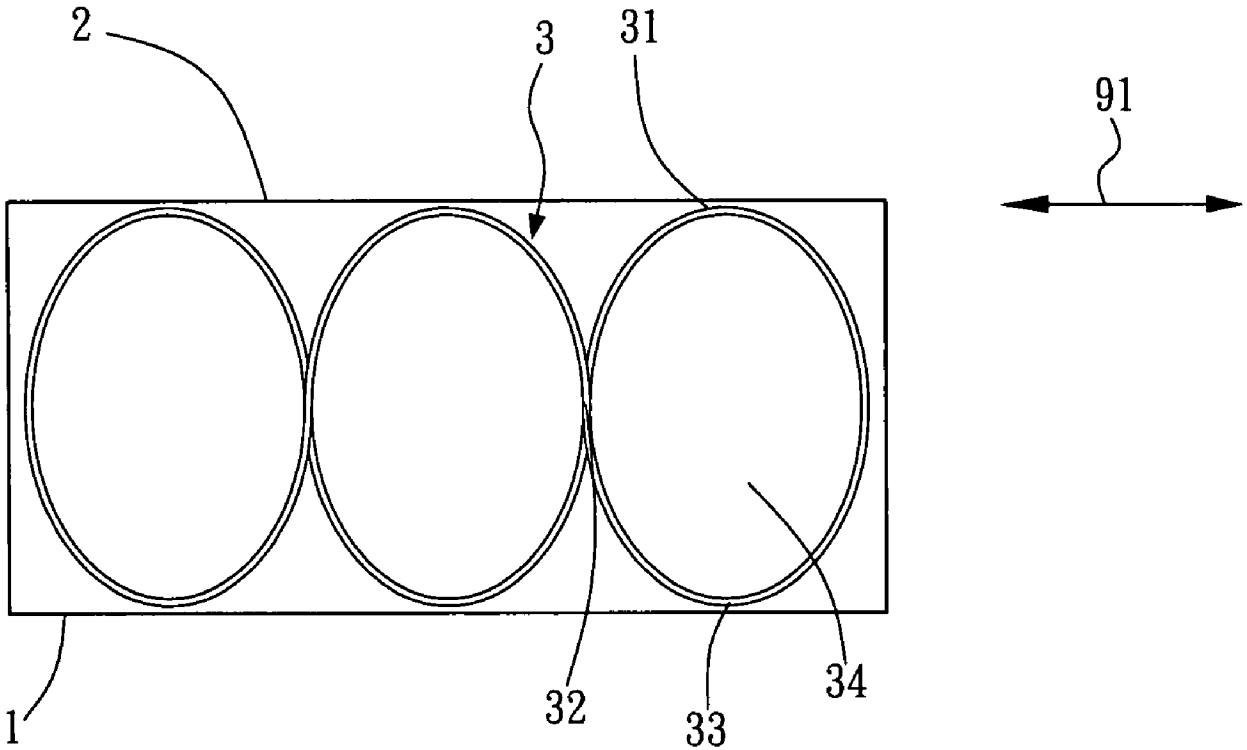
FIG. 1E is a first schematic drawing showing the disclosed foldable frame structure being folded.
Figure 1F:
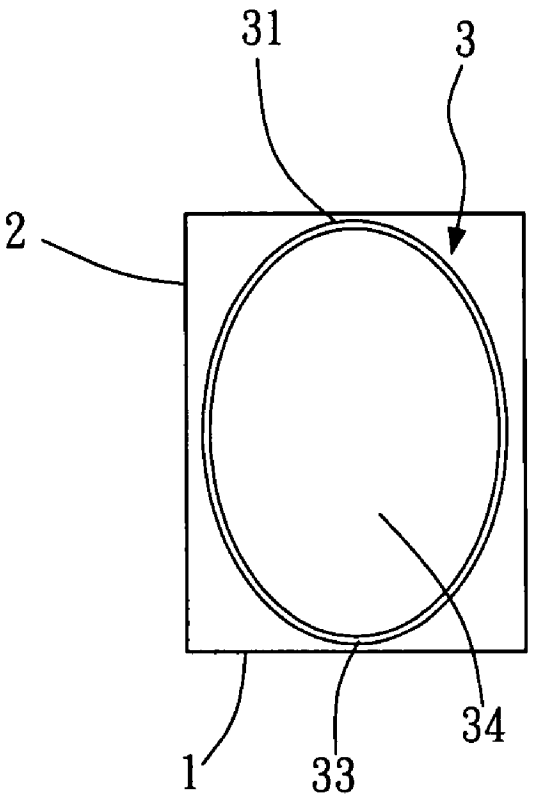
FIG. 1F is a second schematic drawing showing the disclosed foldable frame structure being folded.

Now refer to FIGS. 1E and 1F, which illustrate the disclosed folded frame structure in the status of being folded. To collapse the foldable frame structure of the present invention, firstly, a user may fold the 8-shaped parts at the plurality of first overlapping ends 31 along the direction perpendicular to the extended direction 91 so as to make the second overlapping ends 32 at the opposite sides of the 8-shaped parts become contacted with one another correspondingly, while the contacting ends 33 become contacted with one another correspondingly. Then the user can fold the folded 8-shaped parts along the extended direction 91 to make the plurality of first overlapping ends 31 contact one other correspondingly, so that the plurality of cambered areas 34 can resultantly come into close contact with one another successively, whereby the frame structure can be collapsed for storage. Alternatively, the user can also fold the 8-shaped parts along the extended direction 91 at the plurality of first overlapping ends 31 firstly and then make the plurality of cambered areas 34 come into close contact with each other successively later to collapse the disclosed foldable frame structure.

Figure 2A:
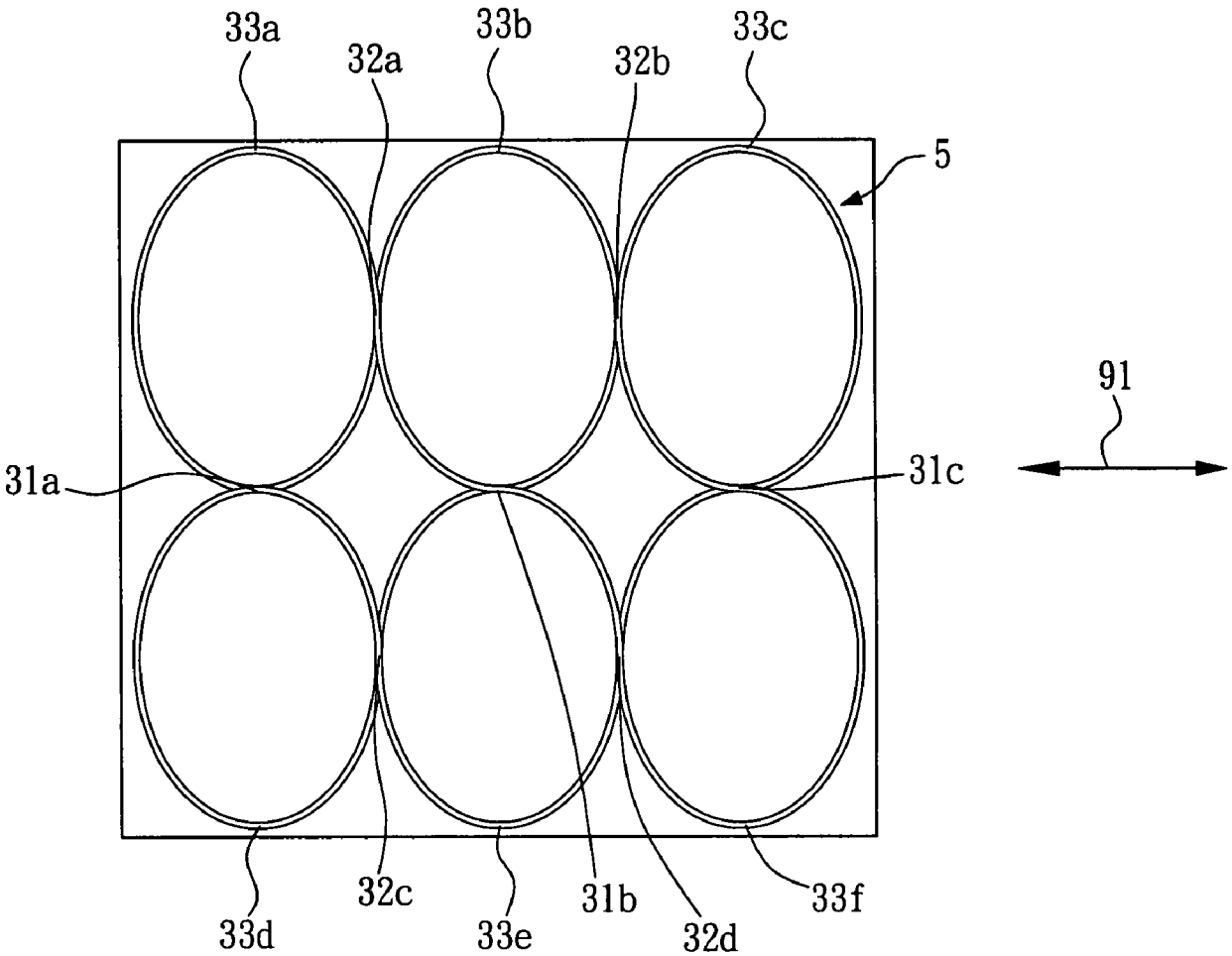
FIG. 2A is a top view showing the disclosed foldable frame structure passing through the first exemplificative combining portion according to the present invention.

According to the present invention, the foldable frame structure may further comprise a combining portion 5, which allows the frame body 3 to pass therethrough and be positioned with respect to the canopy portion 2. Please refer to FIG. 2A for a top view showing the frame structure of the present invention passing through a first exemplificative combining portion according to the present invention. In the present embodiment, the combining portion 5 is sewed to the canopy portion 2 and formed as three hollow 8-shaped parts aligned along the extended direction 91. Consequently, the frame body 3 has three first overlapping ends 31, four second overlapping ends 32, and six contacting ends 33. For the purpose of illustration, the plurality of first overlapping ends 31 are defined as 31*a*, 31*b* and 31*c* sequentially along the extended direction 91 in the following description. Meantime, the plurality of contacting ends 33 of one side of the 8-shaped parts are defined as 33*a*, 33*b* and 33*c*, while the plurality of contacting ends 33 at the opposite side are defined as 33*d*, 33*e* and 33*f* in sequence. Further, the plurality of second overlapping ends 32 of one side of the 8-shaped parts are successively defined as 32*a* and 32*b*, while the plurality of second overlapping ends 32 of the opposite side are successively defined as 32*c* and 32*d*. As the frame body 3 is made of the elastic material, it is capable of passing through the hollow part of the combining portion 5 in the order of 33*a*, 32*a*, 31*b*, 32*d*, 33*f*, 31*c*, 32*b*, 33*b*, 32*a*, 31*a*, 33*d*, 32*c*, 31*b*, 32*b*, 33*c*, 31*c*, 32*d*, 33*e*, 32*c*, 31*a* and 33*a* and comes to be fixed to the canopy portion 2. Of course, the frame body 3 may be composed of two separate frames, which enter the combining portion 5 at both ends thereof respectively. Alternatively, the frame body 3 may be formed in an integrated manner and the combining portion 5 may be embodied by applying an adhesive on the canopy portion 2 so that the frame body 3 can be bound to the canopy portion 2 by the means of adhesion.

Figure 2B:
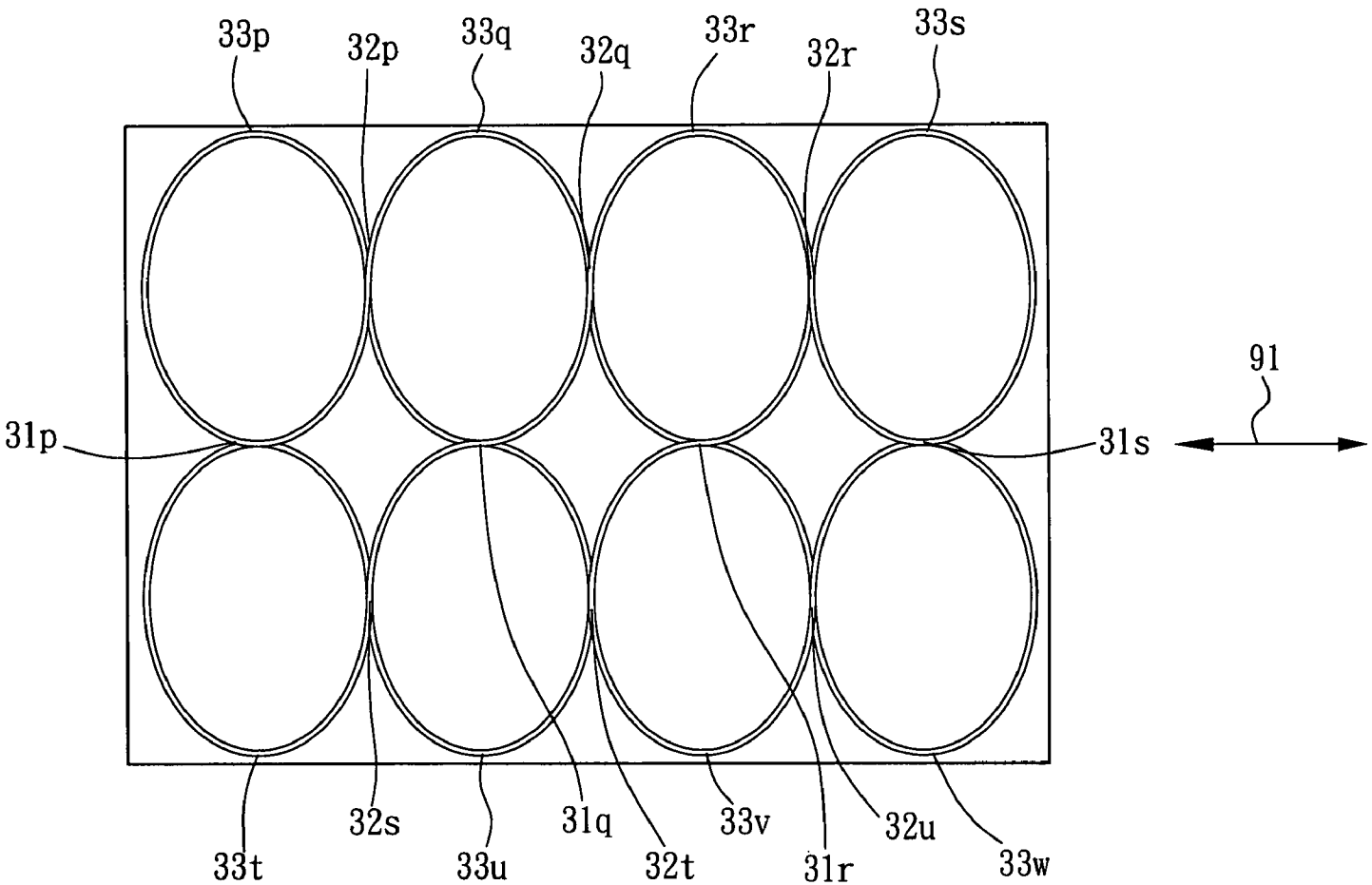
FIG. 2B is a top view showing the disclosed foldable frame structure passing through the second exemplificative combining portion according to the present invention.

According to FIG. 2B, it is a top view showing the disclosed frame structure passing through a second exemplificative combining portion according to the present invention. In the present embodiment, the combining portion 5*a* is sewed to the canopy portion 2 and formed as four hollow 8-shaped parts aligned along the extended direction 91. As the combining portion 5*a* may be a continuous curve line, it can also be formed in a non-continuous manner and contain intervals therein. Consequently, the frame body 3 has four first overlapping ends 31, six second overlapping ends 32, and eight contacting ends 33. For the purpose of illustration, the plurality of first overlapping ends 31 are defined as 31*p*, 31*q*, 31*r* and 31*s* successively along the extended direction 91 in the following description. Meantime, the plurality of contacting ends 33 of one side of the 8-shaped parts are defined as 33*p*, 33*q*, 33*r* and 33*s*, while the plurality of contacting ends 33 of the opposite side are defined as 33*t*, 33*u*, 33*v* and 33*w* in sequence. Similarly, the plurality of second overlapping ends 32 of one side of the 8-shaped parts are successively defined as 32*p*, 32*q* and 32*r*, while the plurality of second overlapping ends 32 of the opposite side are successively defined as 32*s*, 32*t* and 32*u*. As the frame body 3 is made of the elastic material, it is capable of passing through the hollow part of the combining portion 5*a* in the order of 33*t*, 32*s*, 31*q*, 32*q*, 33*r*, 32*r*, 31*s*, 33*s*, 32*r*, 31*r*, 32*t*, 33*v*, 32*u*, 31*s*, 33*w*, 32*u*, 31*r*, 32*q*, 33*q*, 32*p*, 31*p*, 33*p*, 32*p*, 31*q*, 32*t*, 33*u*, 32*s*, 31*p* and 33*t* and comes to be fixed to the canopy portion 2. Certainly, the frame body 3 may be composed of two or more separate frames. When the frame body 3 is composed of two separate frames, one of the frames 3 passes through 33*t*, 32*s*, 31*q*, 32*q*, 33*r*, 32*r*, 31*s*, 33*w*, 32*u*, 31*r*, 32*q*, 33*q*, 32*p*, 31*p* and 33*t* successively, while the other frame 3 passes through 33*p*, 31*p*, 32*s*, 33*u*, 32*t*, 31*r*, 32*r*, 33*s*, 31*s*, 31*r*, 33*v*, 32*t*, 31*q*, 32*p* and 33*p* successively. It is to be understood that the previously described embodiments are provided for purposes of illustration but not limitation.

Since most of the components in the following illustrated embodiments are identical or similar to those of the above-mentioned embodiments, identical name and numeral are imparted to identical components, while identical name is imparted with an additional letter added after the same numeral to similar components for the purpose of distinction.

Figure 3A:
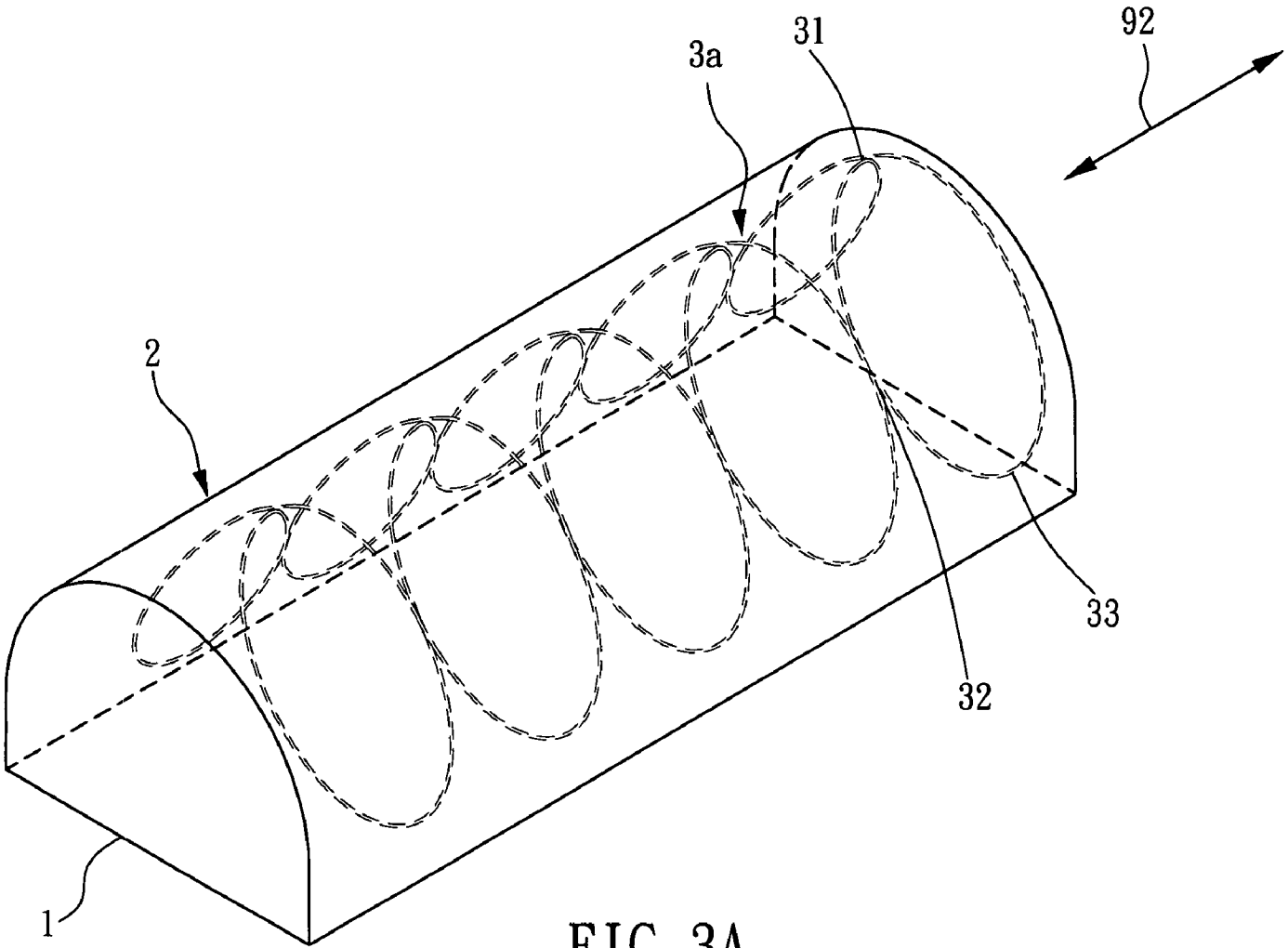
FIG. 3A is an assembly drawing of the disclosed foldable frame structure according to the second preferred embodiment of the present invention.
Figure 3B:
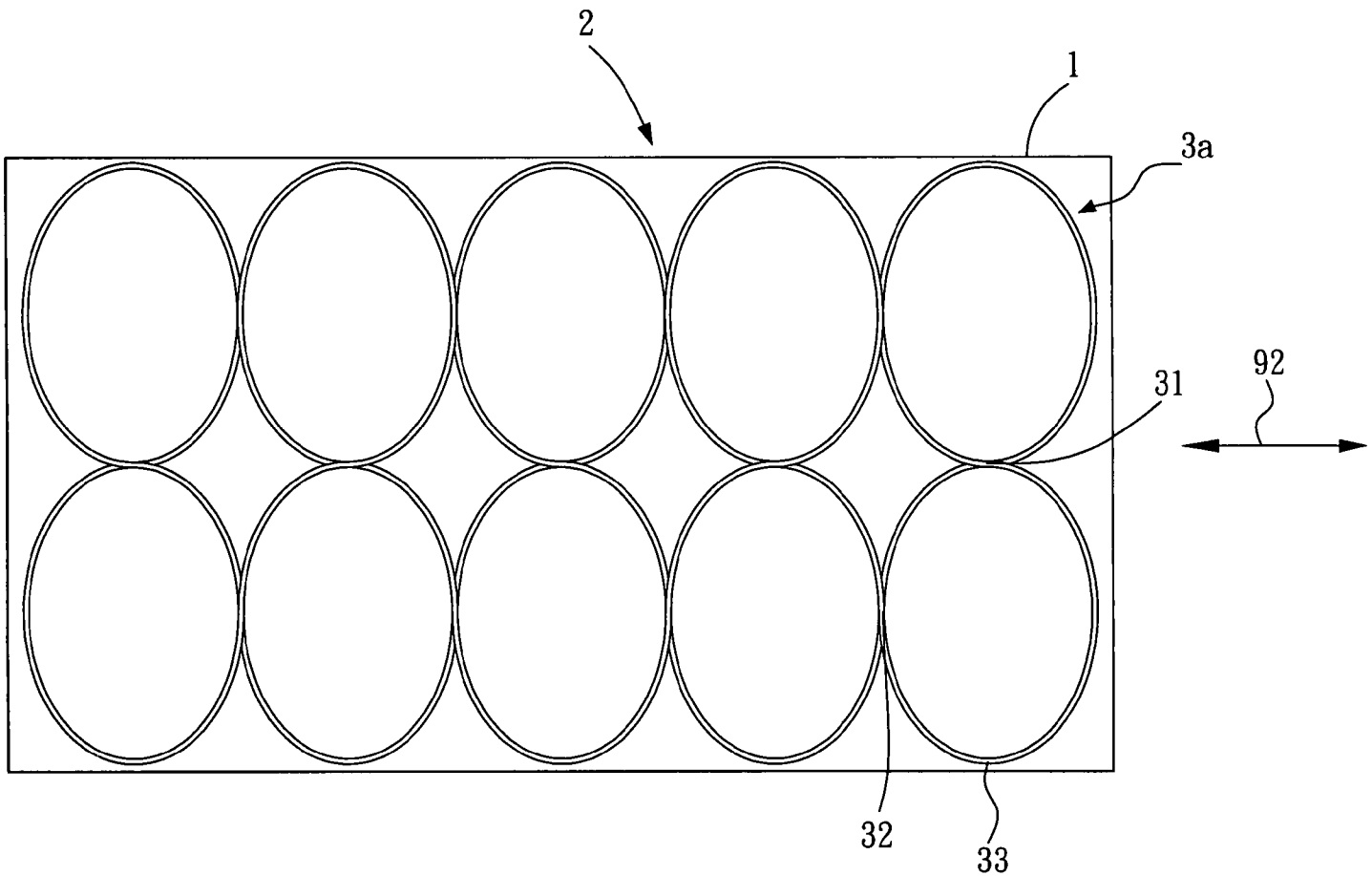
FIG. 3B is a front view of the disclosed foldable frame structure according to the second preferred embodiment of the present invention.
Figure 3C:
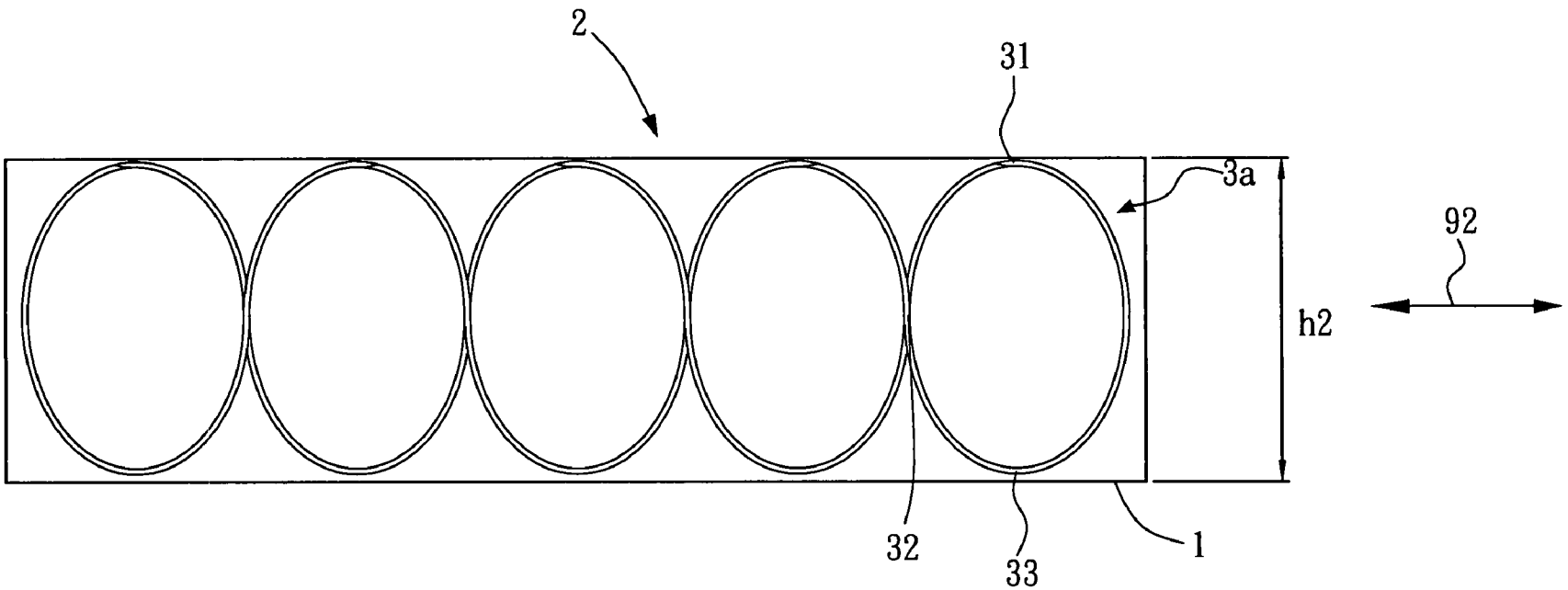
FIG. 3C is a top view of the disclosed foldable frame structure according to the second preferred embodiment of the present invention.
Figure 4A:
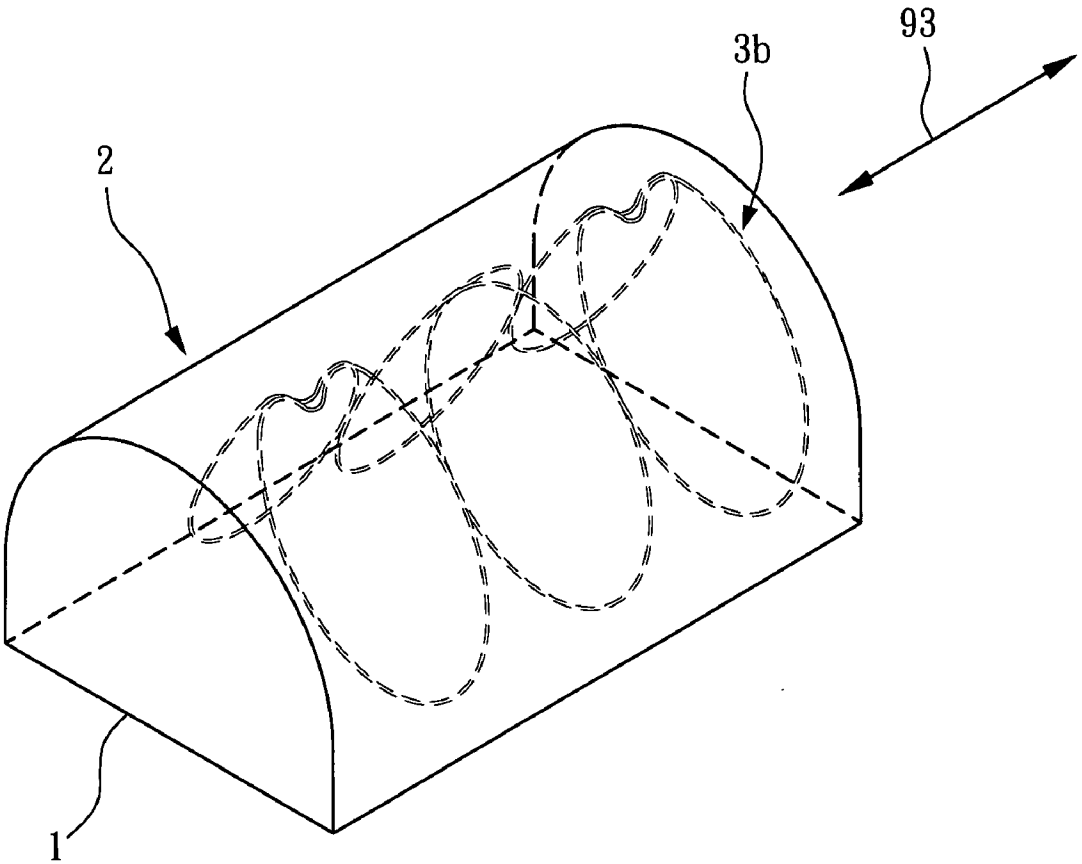
FIG. 4A is an assembly drawing of the disclosed foldable frame structure according to a third preferred embodiment of the present invention.
Figure 4B:
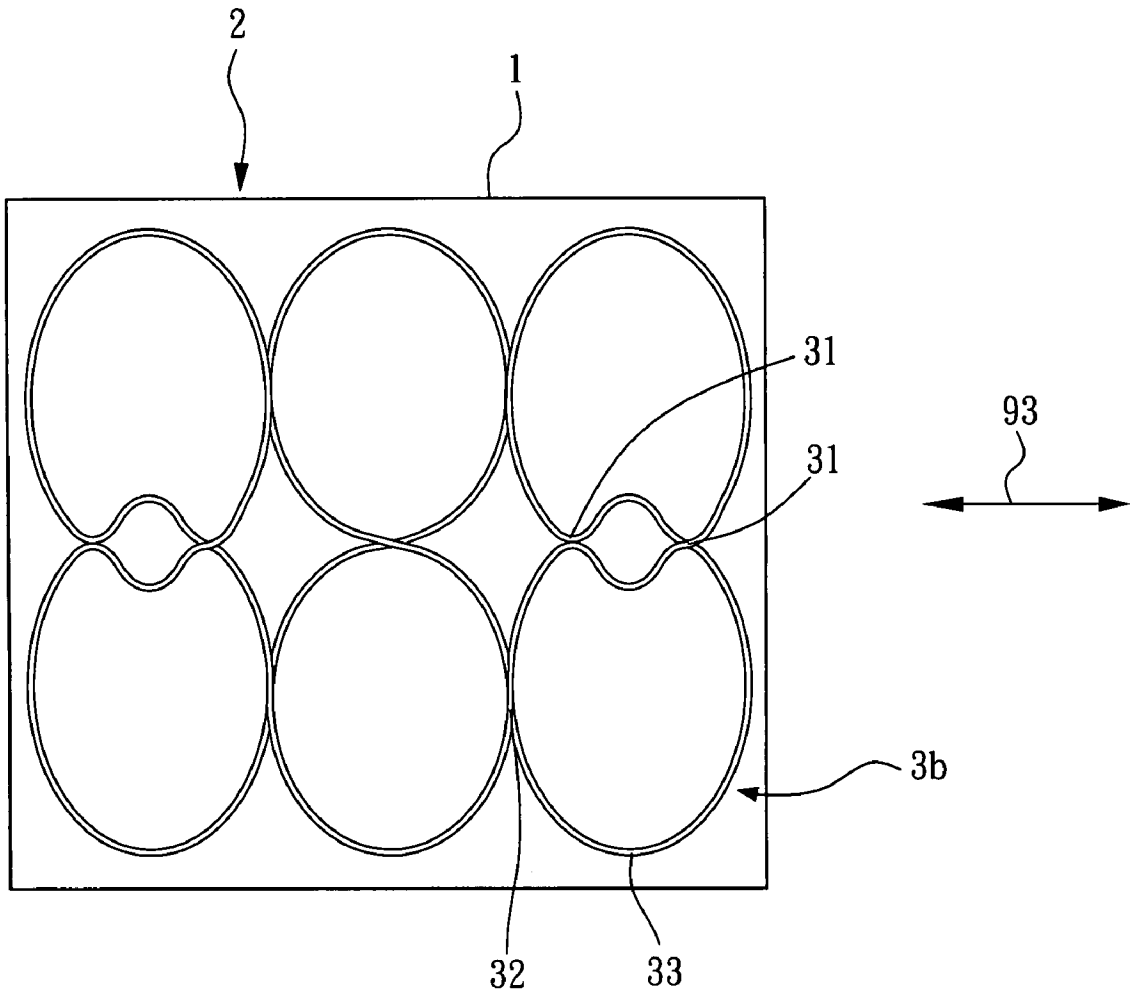
FIG. 4B is a front view of the disclosed foldable frame structure according to the third preferred embodiment of the present invention.
Figure 4C:
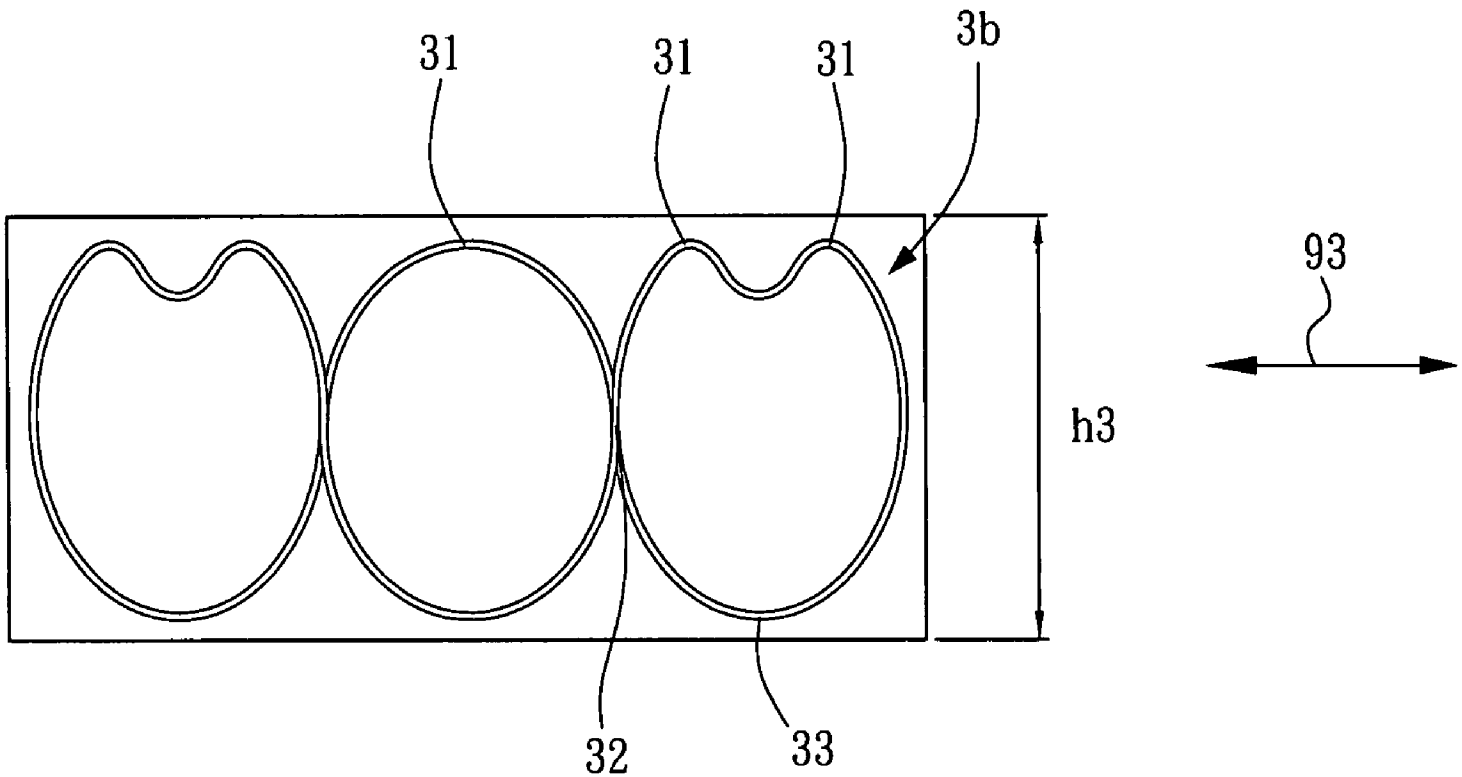
FIG. 4C is a top view of the disclosed foldable frame structure according to the third preferred embodiment of the present invention.

Please refer to FIGS. 3A through 3C for the assembly drawing, front view and top view of the disclosed foldable frame structure according to the second preferred embodiment of the present invention. In the present embodiment, the frame body 3*a* is designed as five 8-shaped parts ranked along an extended direction 92 and comprises five first overlapping ends 31, eight second overlapping ends 32 and ten contacting ends 33, whereby the frame body 3*a* extends for a longer length along the extended direction 92. In the third embodiment of the present invention as illustrated through FIGS. 4A to 4C, the frame body 3*b* is designed as three 8-shaped parts aligned along an extended direction 93 and comprises five first overlapping ends 31, four second overlapping ends 32 merely, and six contacting ends 33. As it will be understood by one of ordinary skill in the art that numerous variations of the structures and figures will be possible to the disclosed embodiment without going outside the scope of the invention, the variations of the structures and figures will not be discussed in great details herein.

Figure 5A:
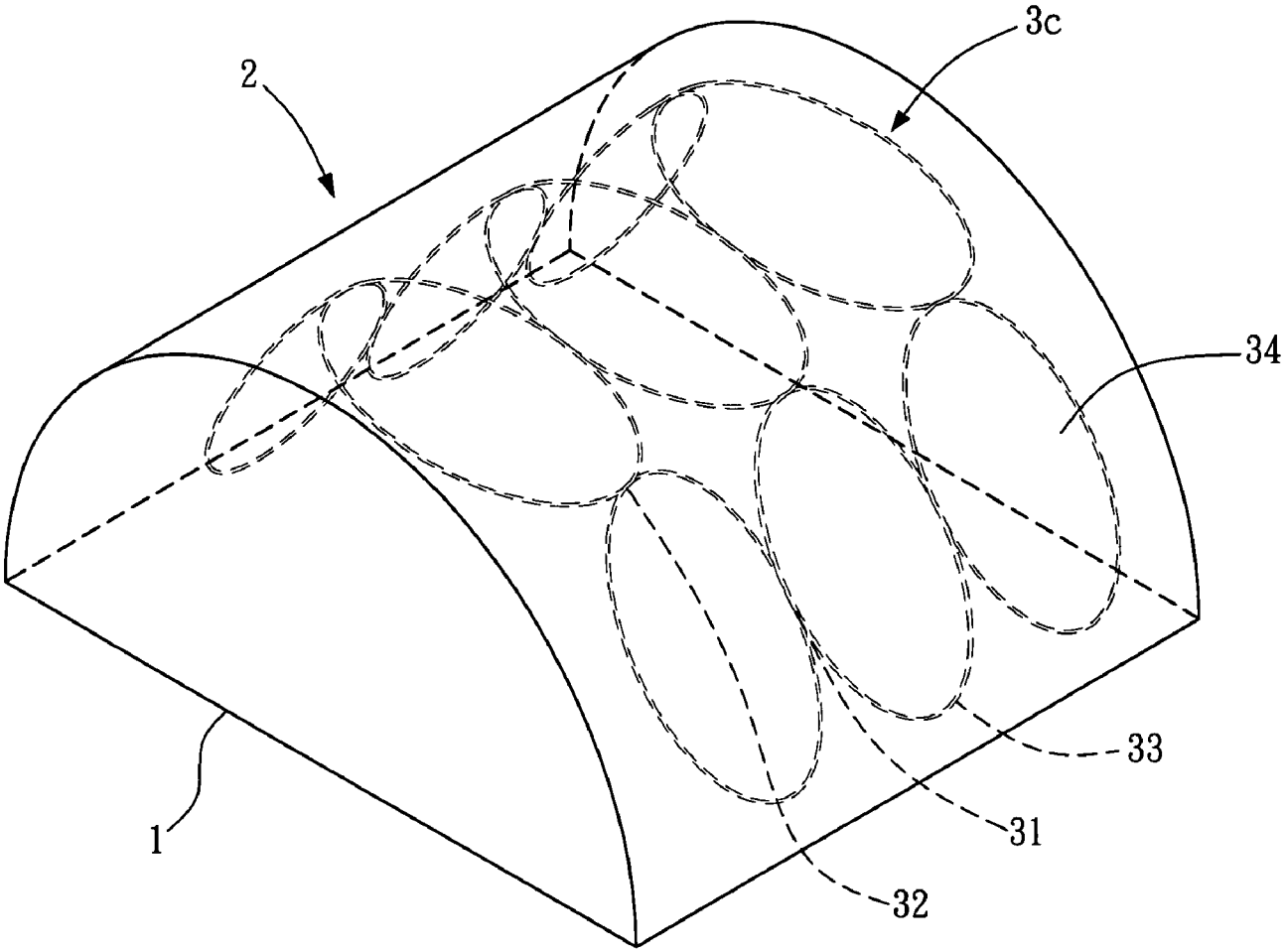
FIG. 5A is an assembly drawing of the disclosed foldable frame structure according to a fourth preferred embodiment of the present invention.
Figure 5B:
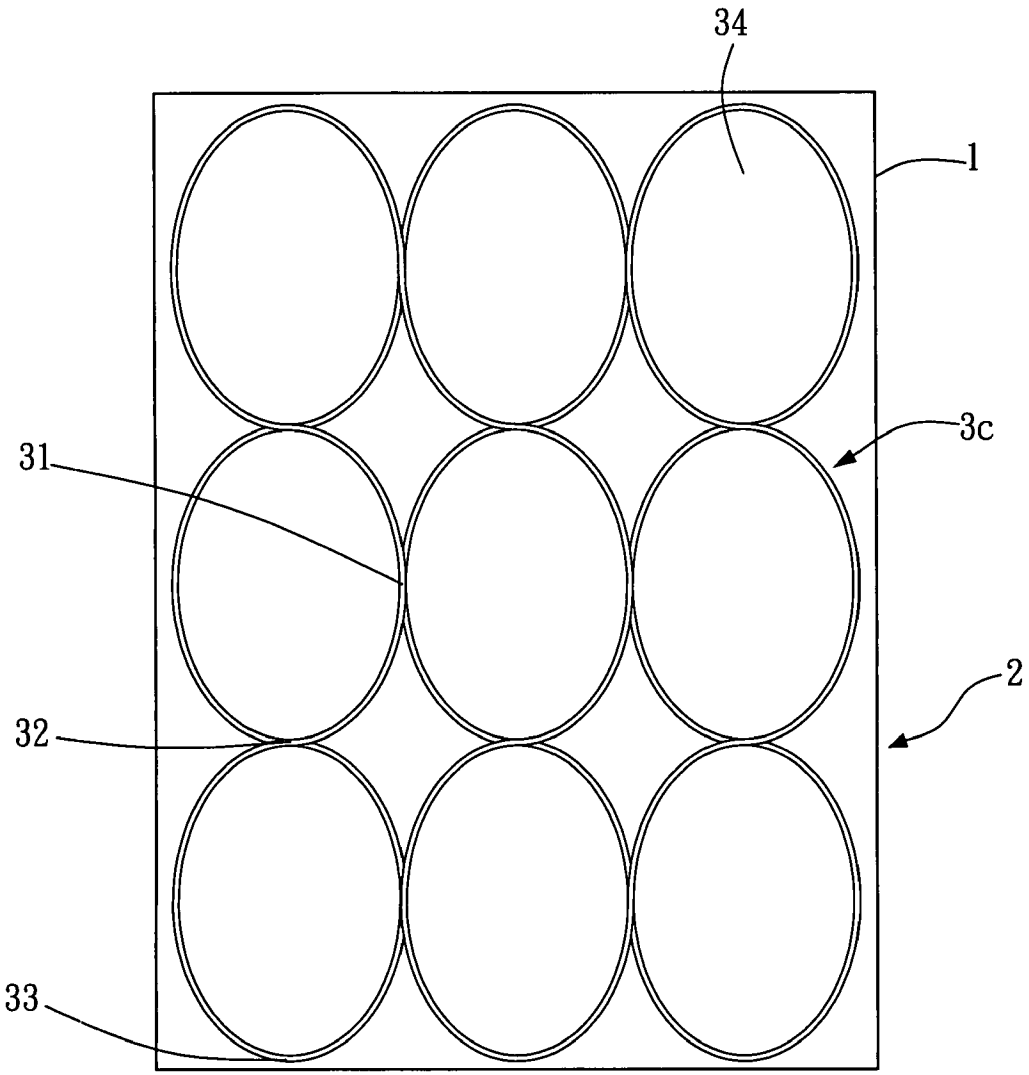
FIG. 5B is a front view of the disclosed foldable frame structure according to the fourth preferred embodiment of the present invention.
Figure 5C:
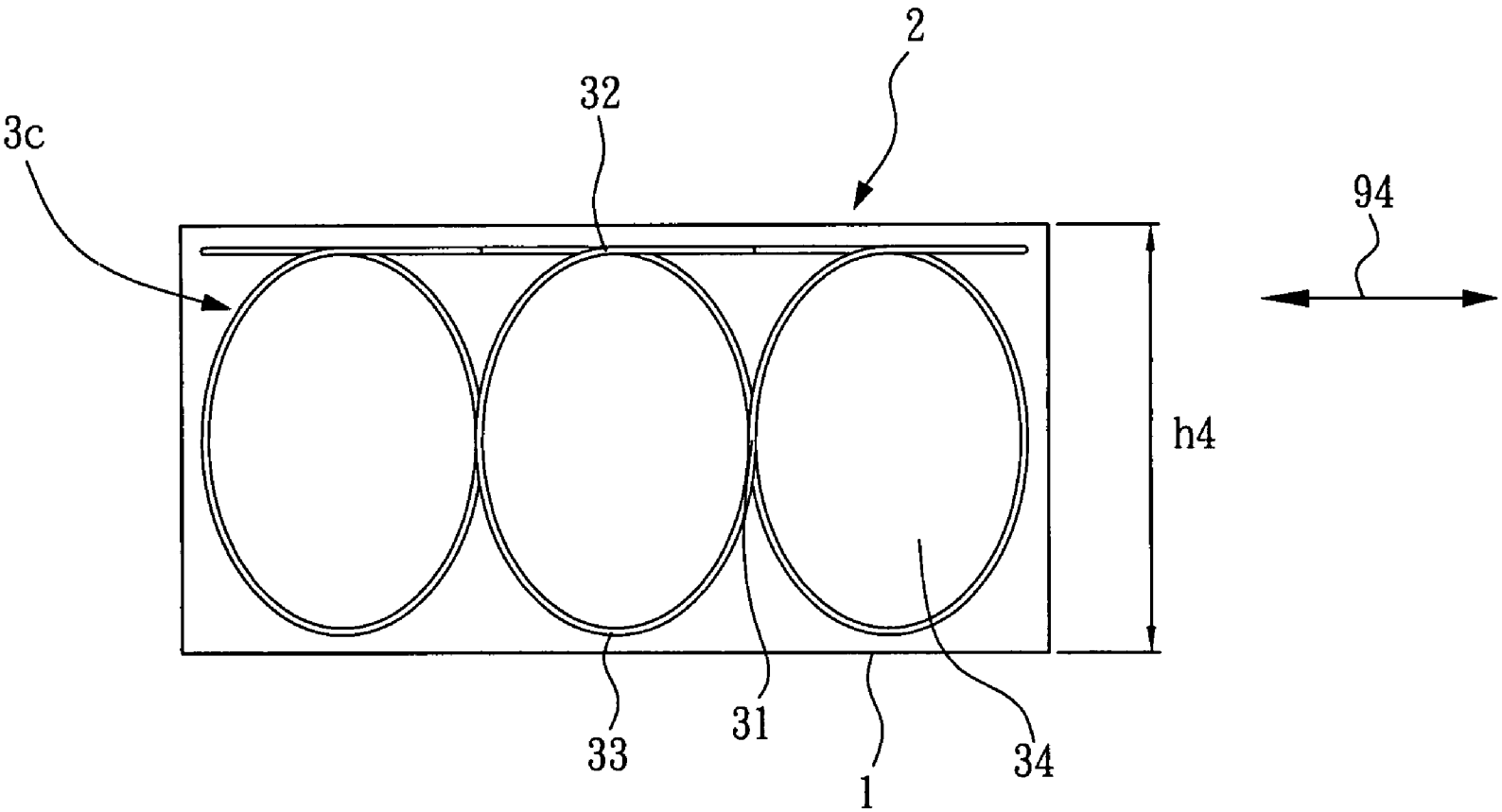
FIG. 5C is a top view of the disclosed foldable frame structure according to the fourth preferred embodiment of the present invention.
Figure 6A:
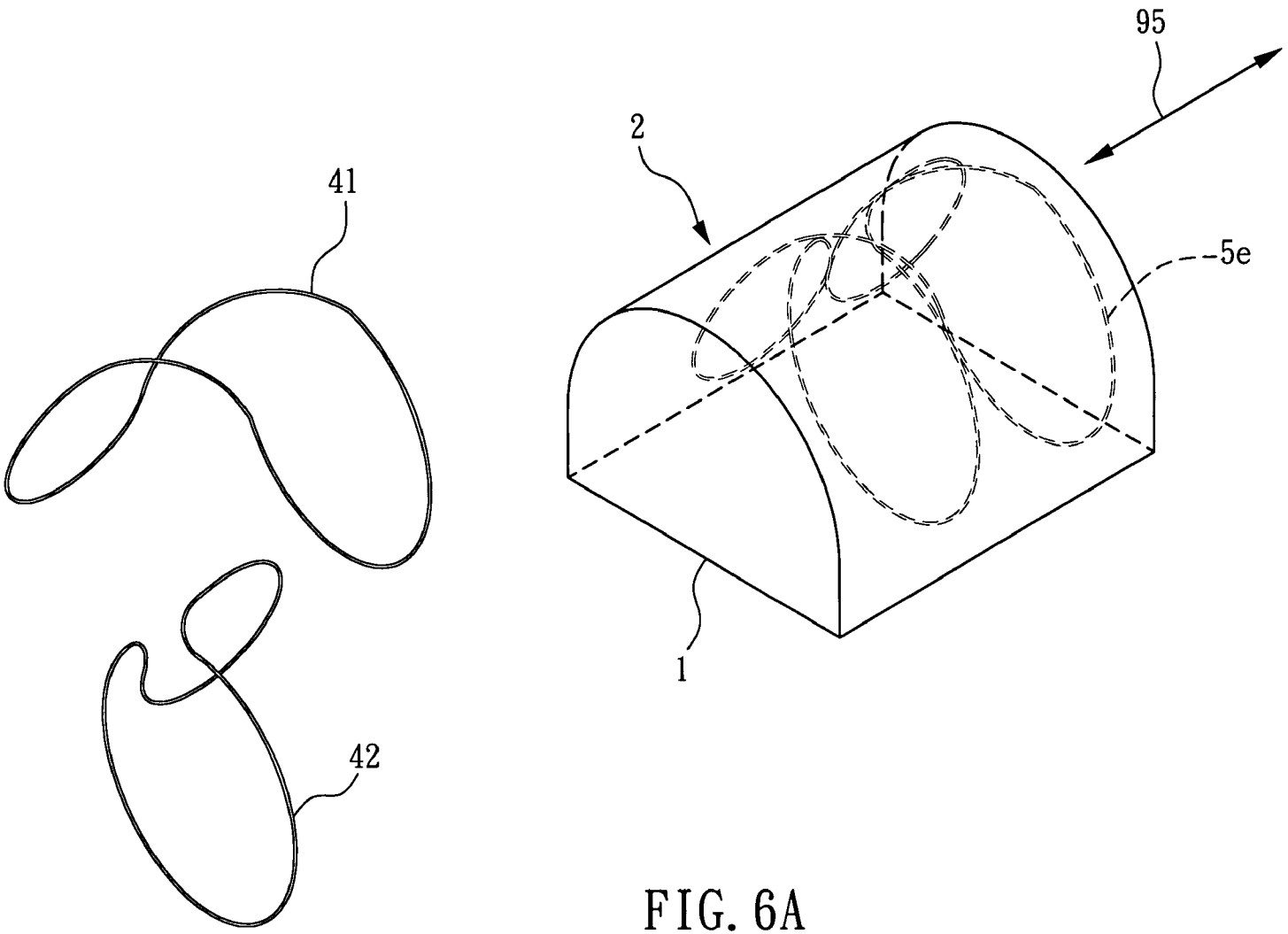
FIG. 6A is an exploded view of the disclosed foldable frame structure according to a fifth preferred embodiment of the present invention.
Figure 6B:
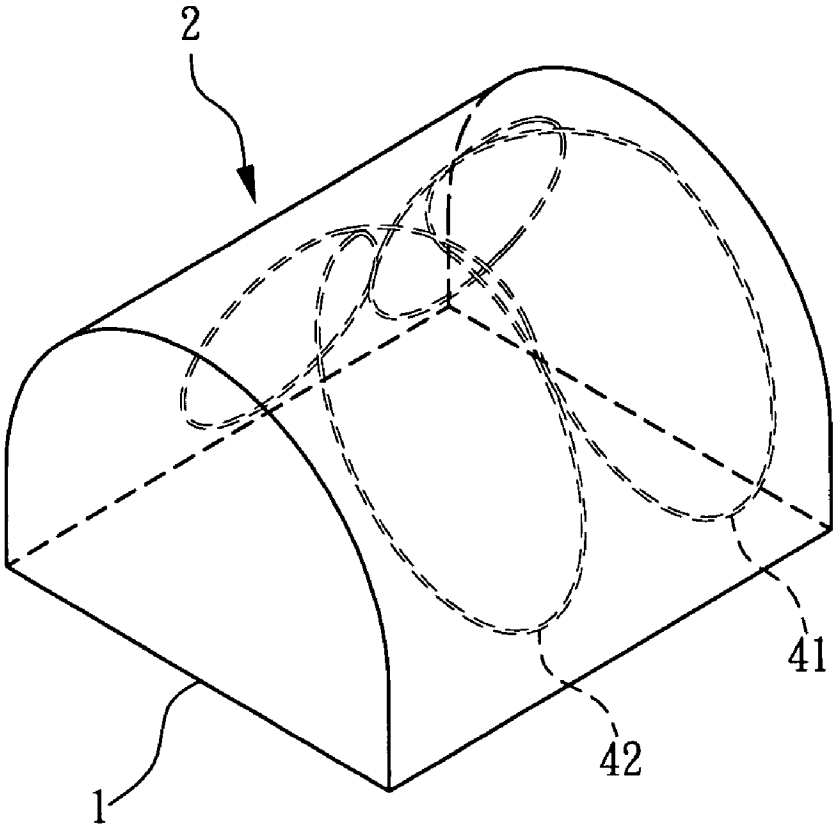
FIG. 6B is an assembly drawing of the disclosed foldable frame structure according to the fifth preferred embodiment of the present invention.
Figure 6C:
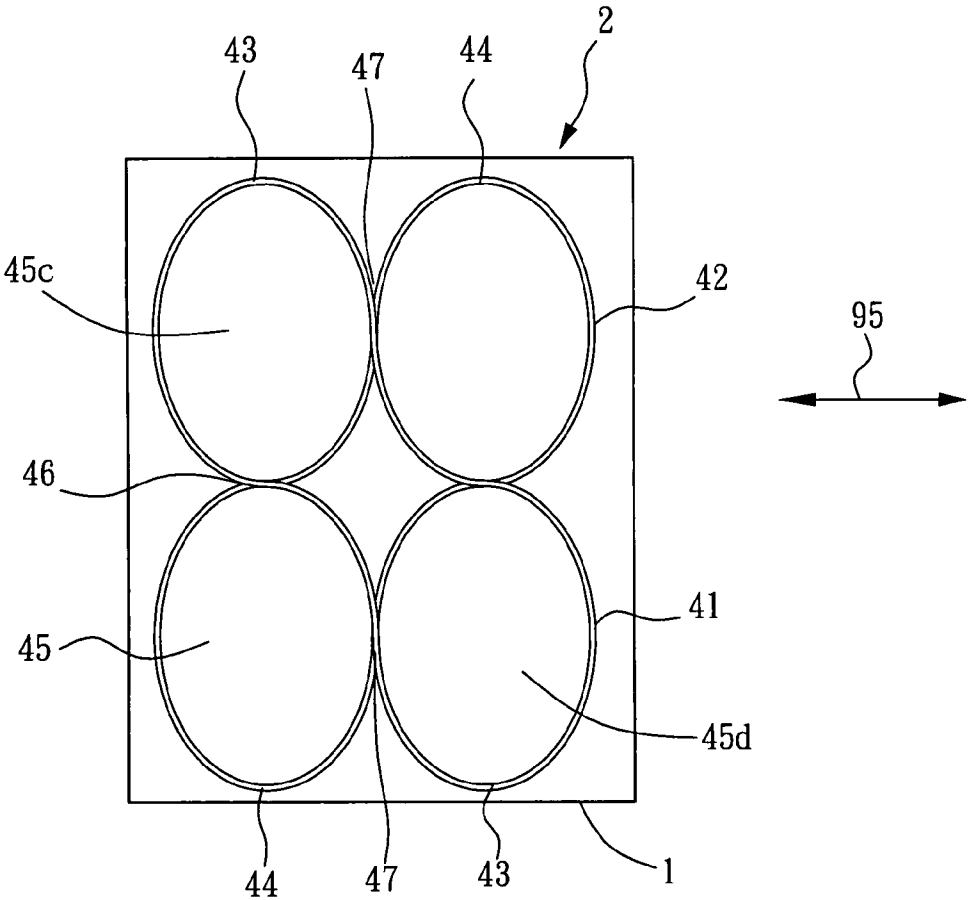
FIG. 6C is a front view of the disclosed foldable frame structure according to the fifth preferred embodiment of the present invention.
Figure 6D:
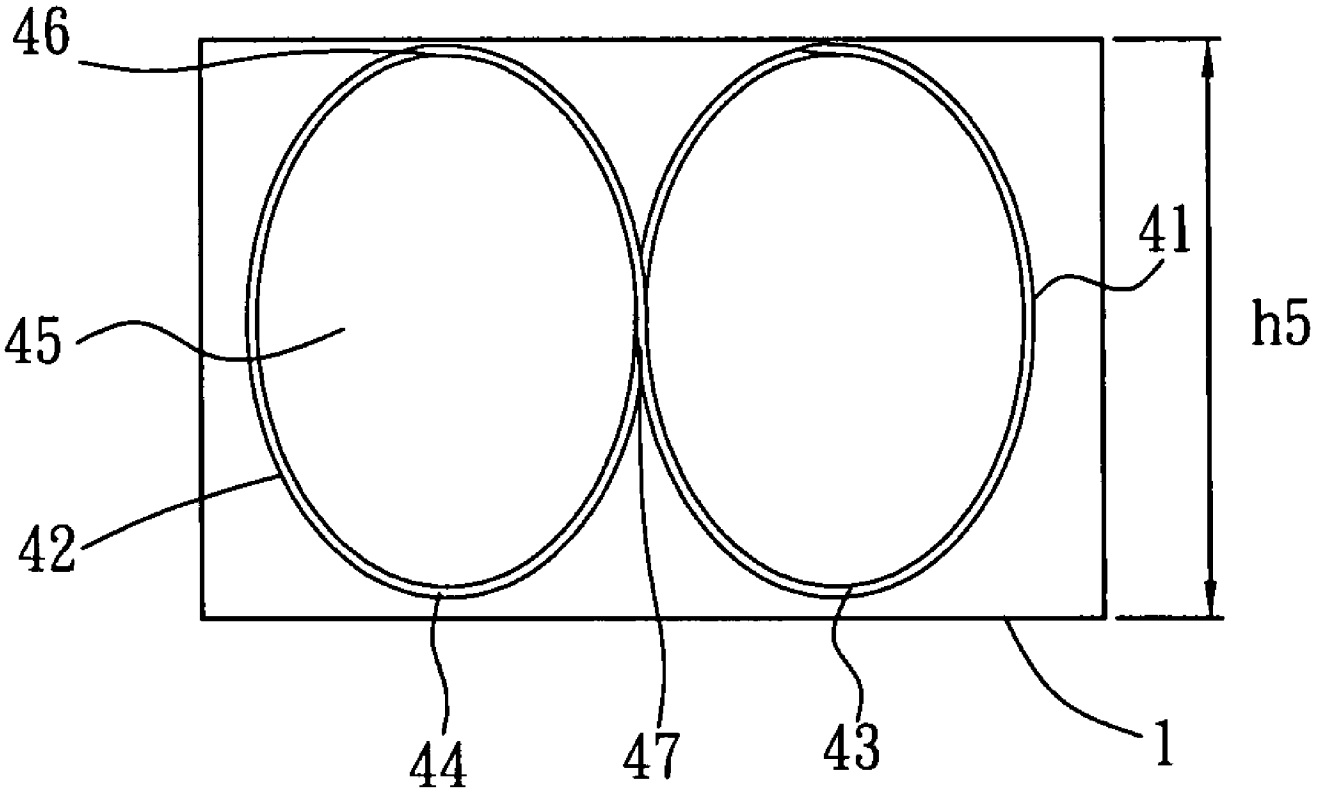
FIG. 6D is a top view of the disclosed foldable frame structure according to the fifth preferred embodiment of the present invention.
Figure 7A:
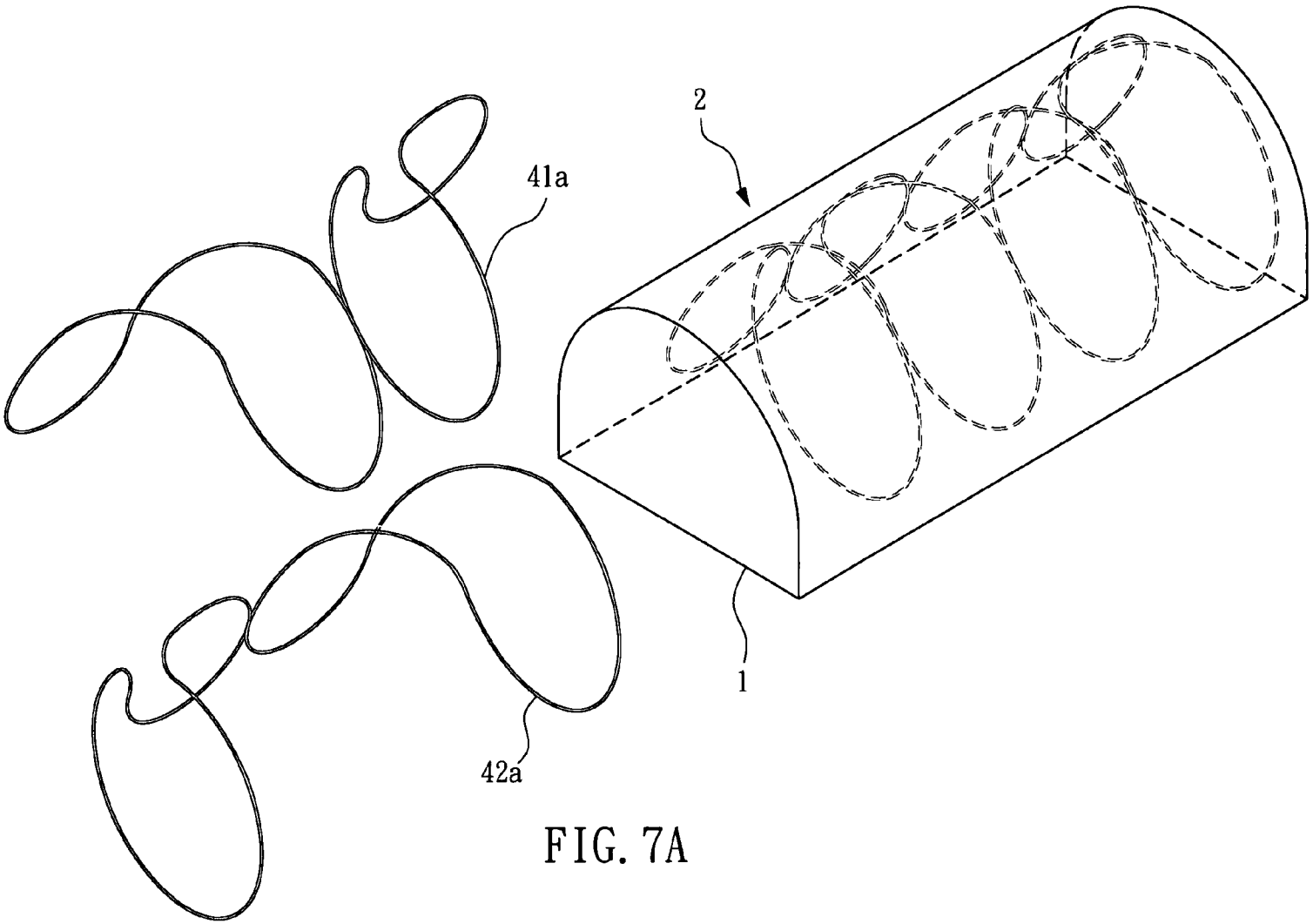
FIG. 7A is an exploded view of the disclosed foldable frame structure according to a sixth preferred embodiment of the present invention.
Figure 7B:
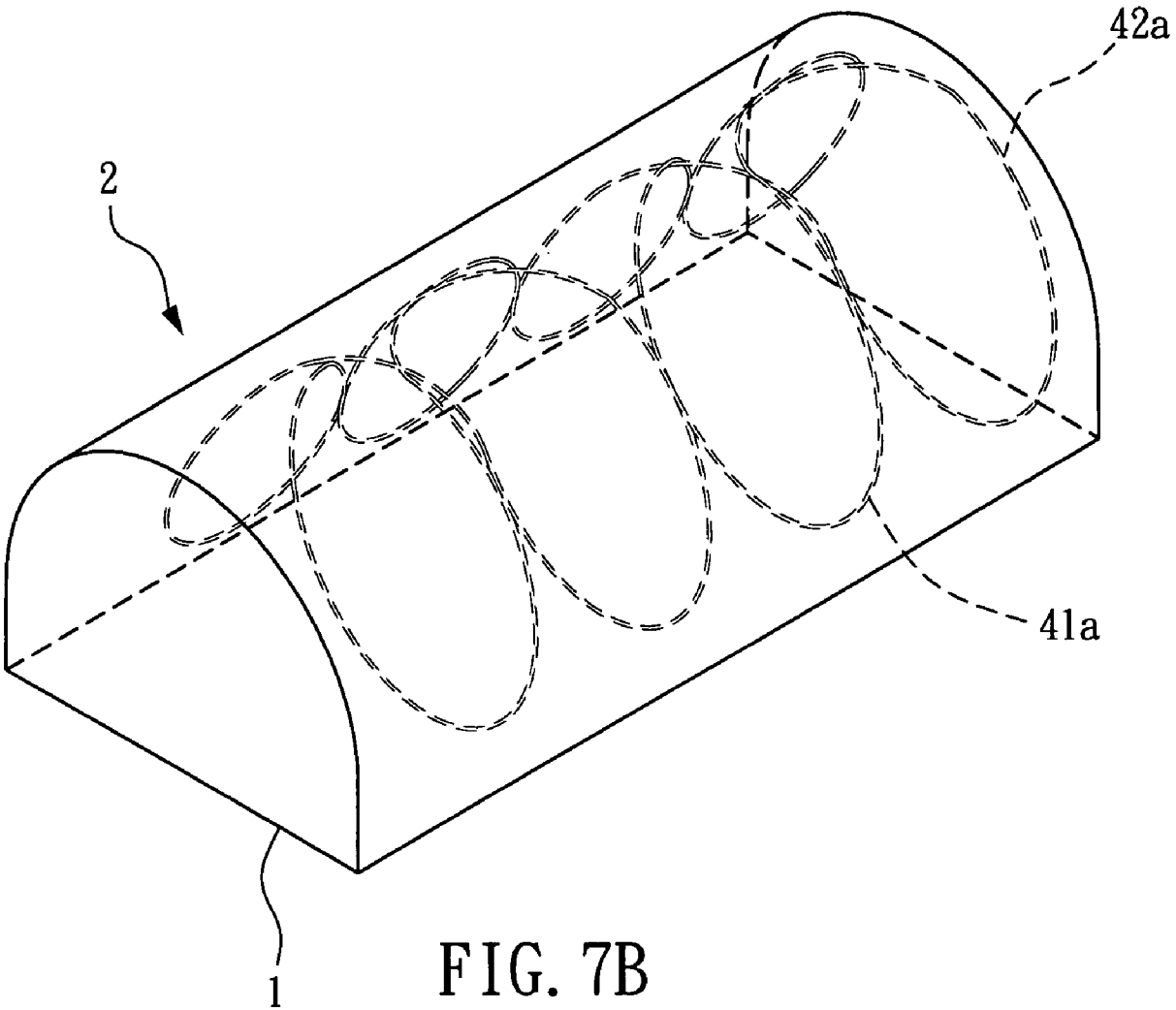
FIG. 7B is an assembly drawing of the disclosed foldable frame structure according to the sixth preferred embodiment of the present invention.
Figure 7C:
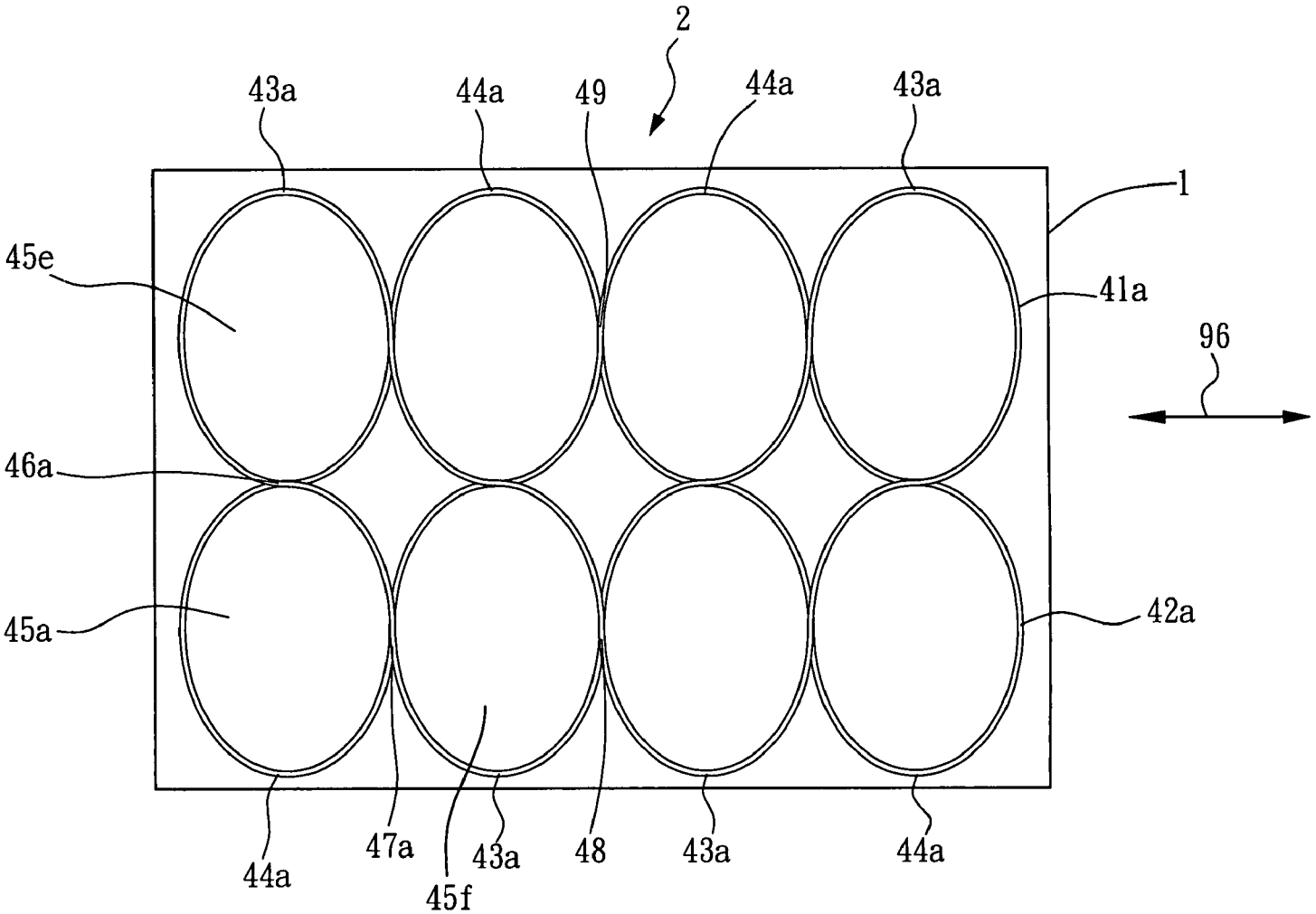
FIG. 7C is the sixth preferred embodiment of the present invention.
Figure 7D:
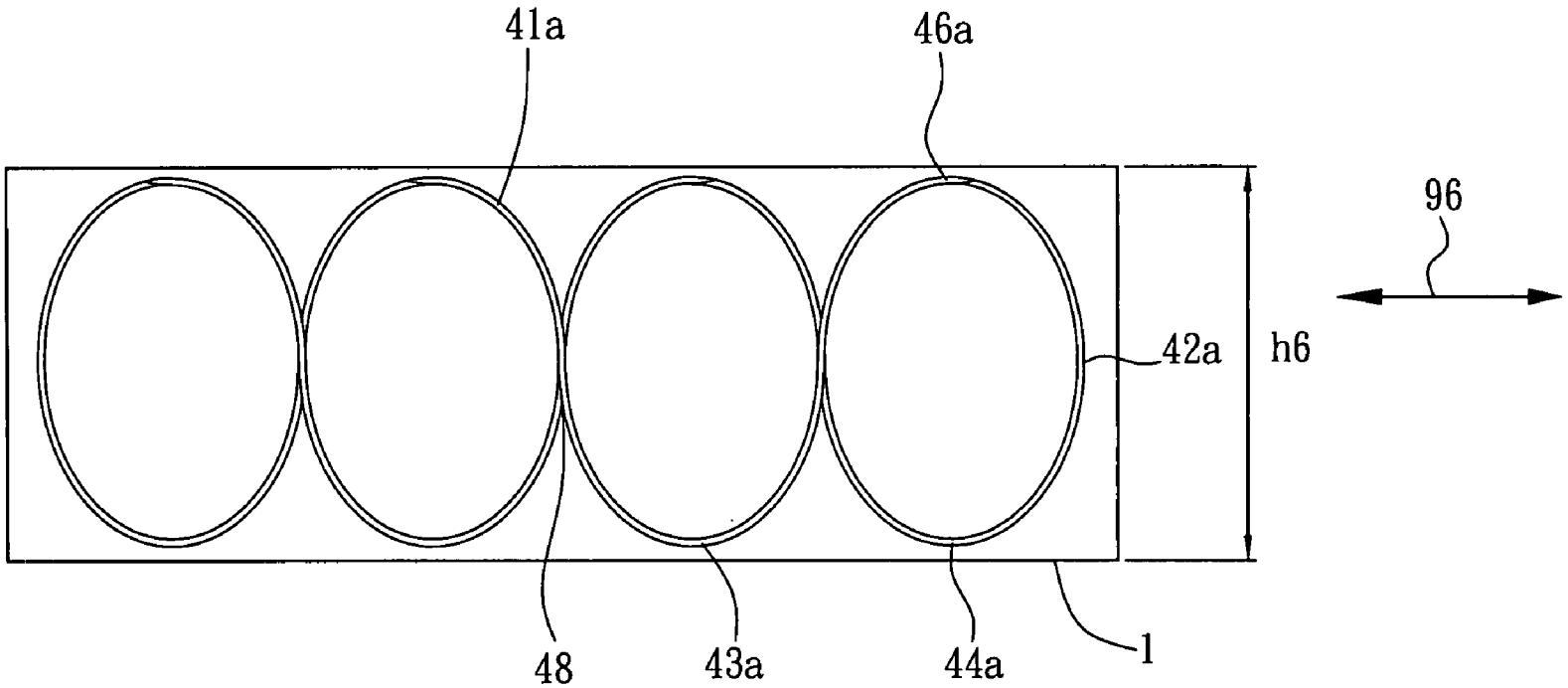
FIG. 7D is a top view of the disclosed foldable frame according to the sixth preferred embodiment of the present invention.
Figure 8A:
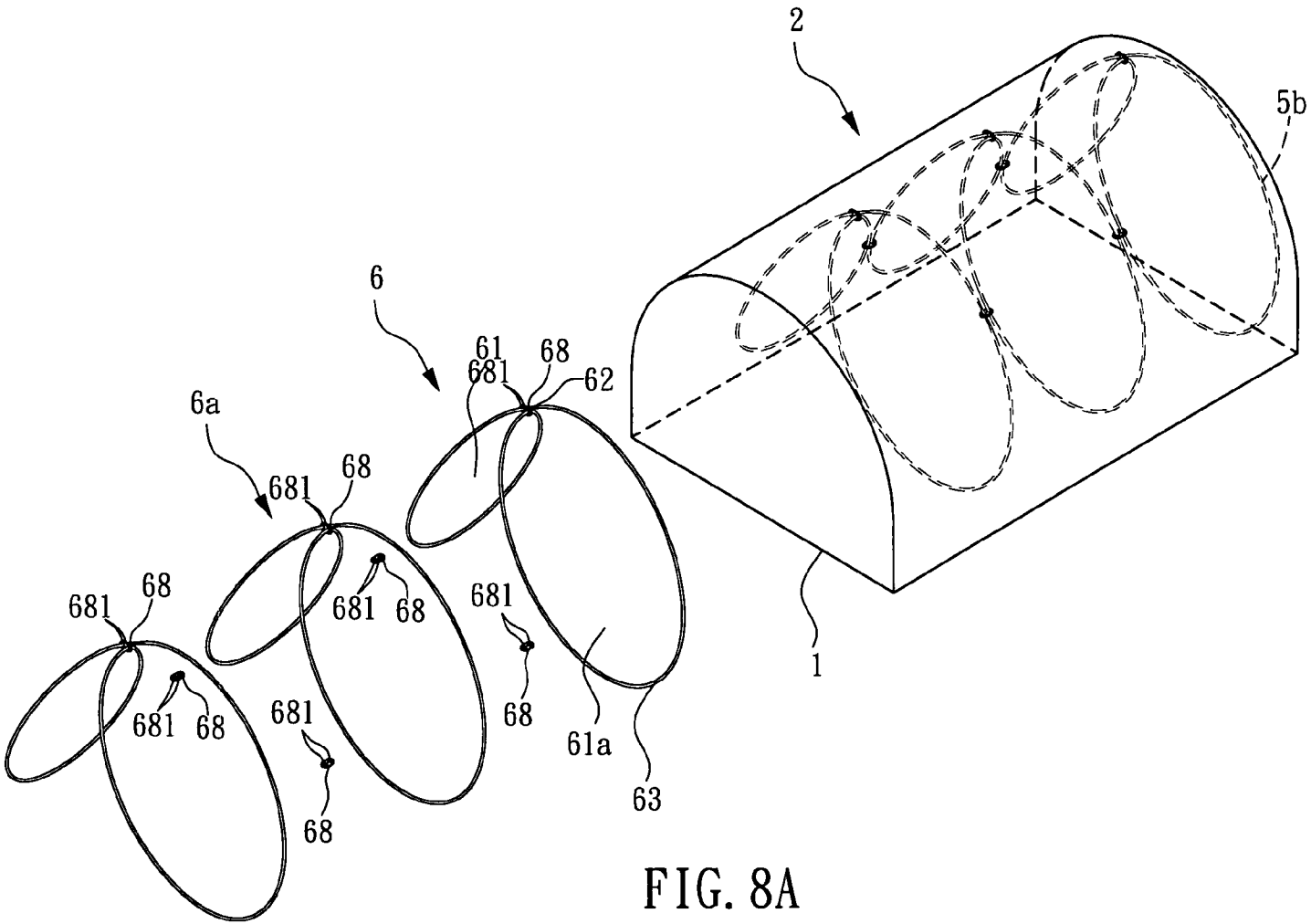
FIG. 8A is an exploded view of the disclosed foldable frame according to a seventh preferred embodiment of the present invention.
Figure 8B:
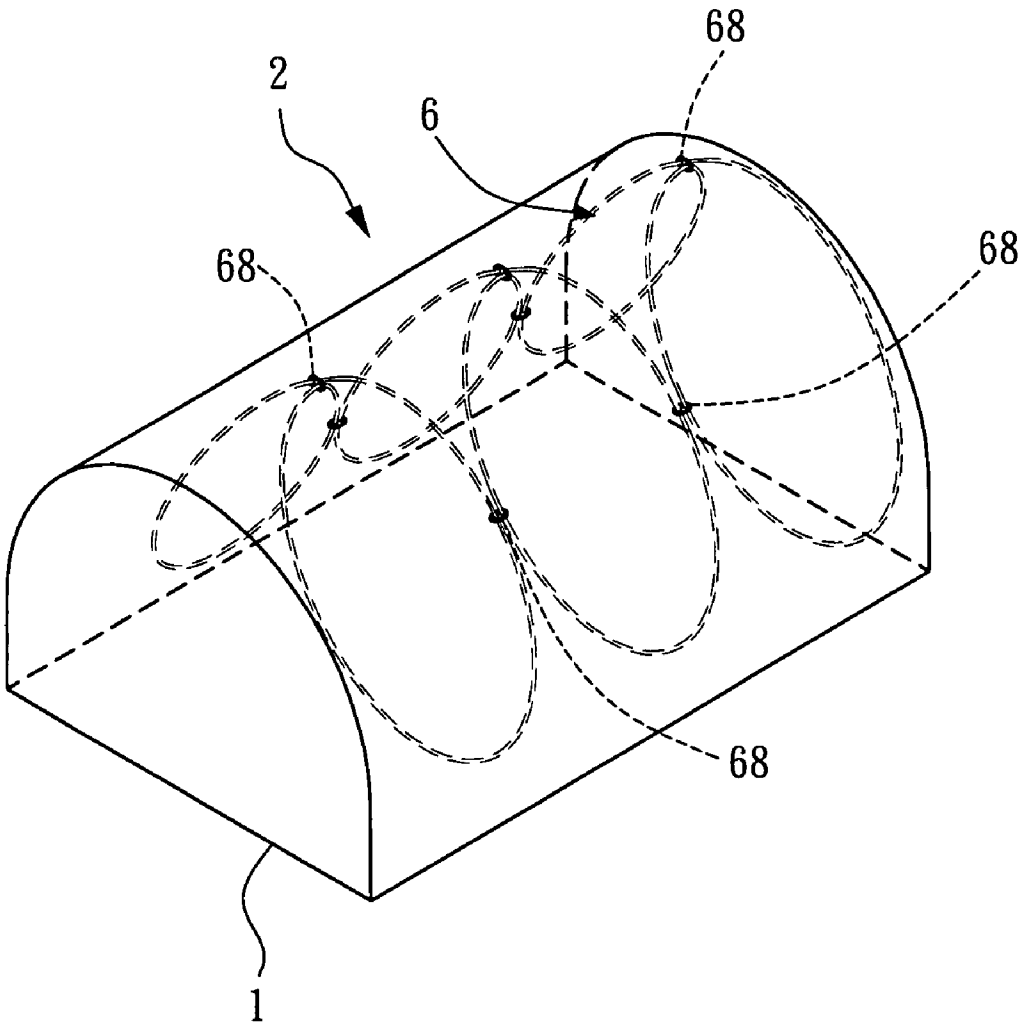
FIG. 8B is a of the disclosed foldable frame according to the seventh preferred embodiment of the present invention.
Figure 8C:
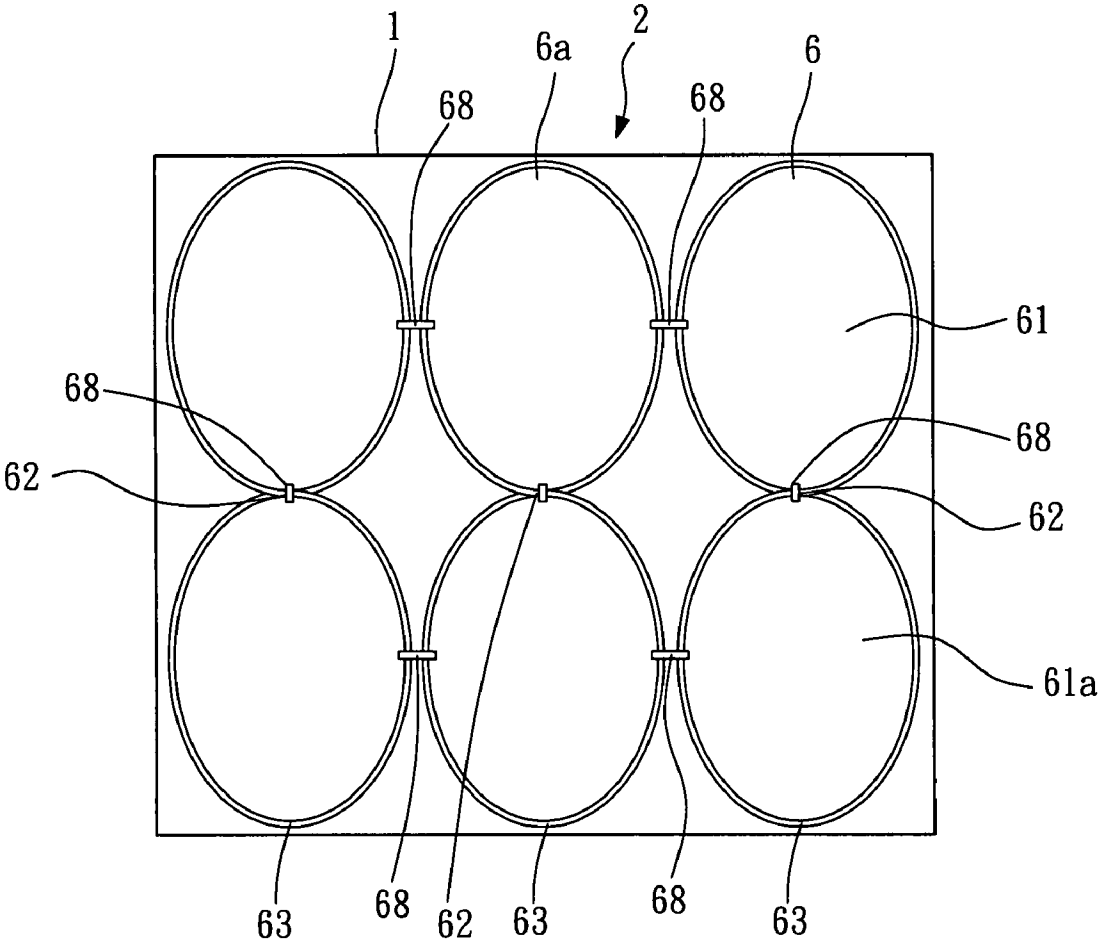
FIG. 8C is a the seventh preferred embodiment of the present invention.
Figure 8D:
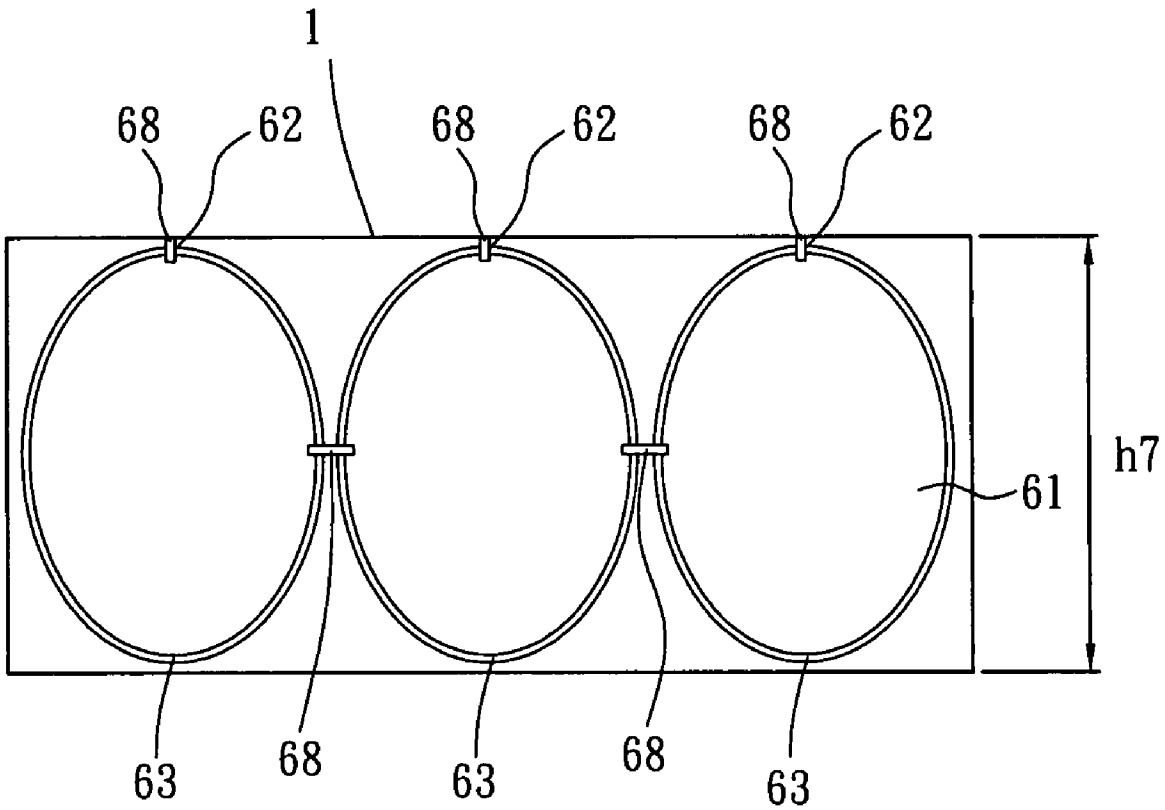
FIG. 8D is a of the disclosed foldable frame according to the seventh preferred embodiment of the present invention.
Figure 9A:
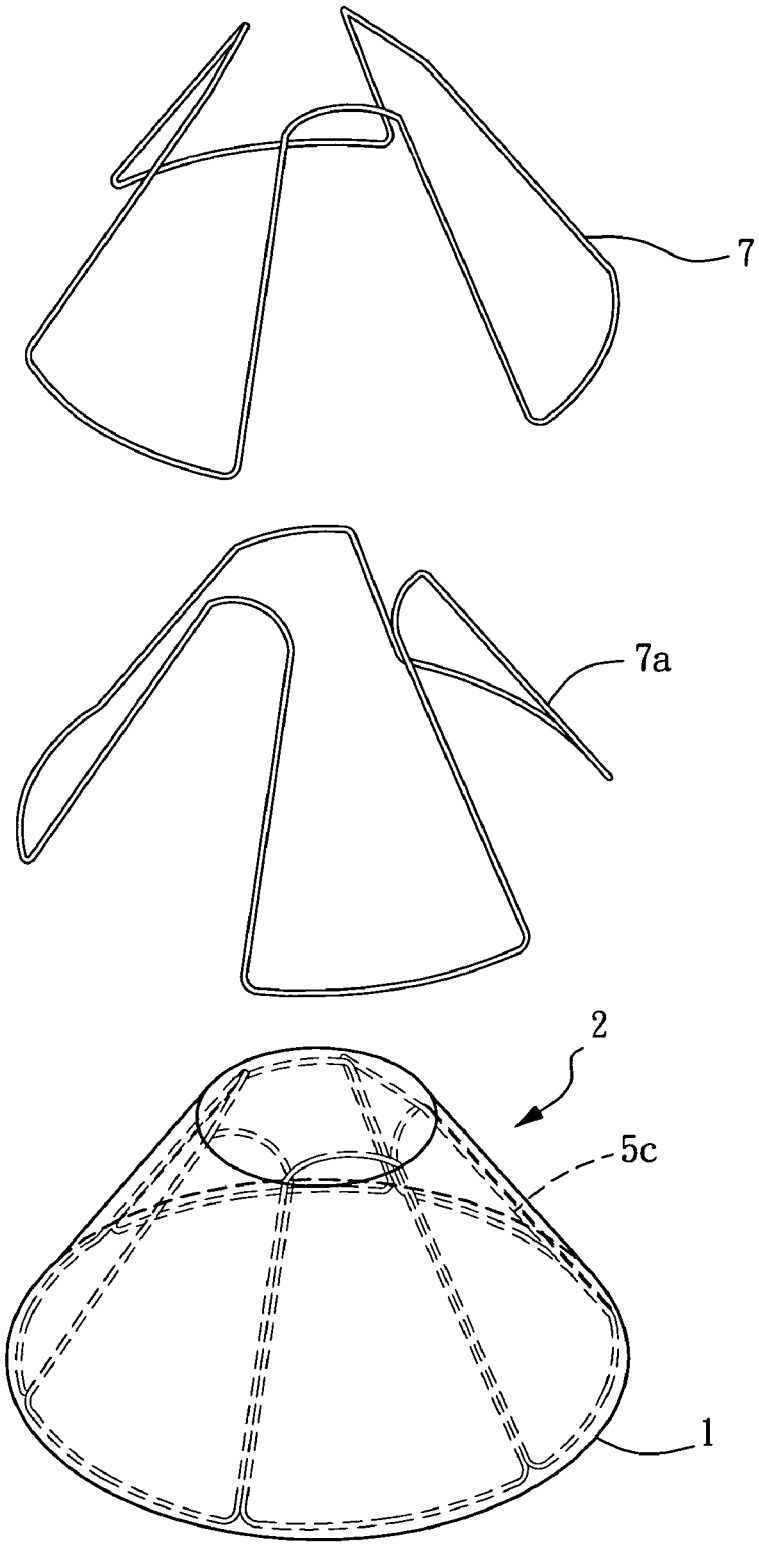
FIG. 9A is an exploded view of the disclosed foldable frame according to an eighth preferred embodiment of the present invention.
Figure 9B:
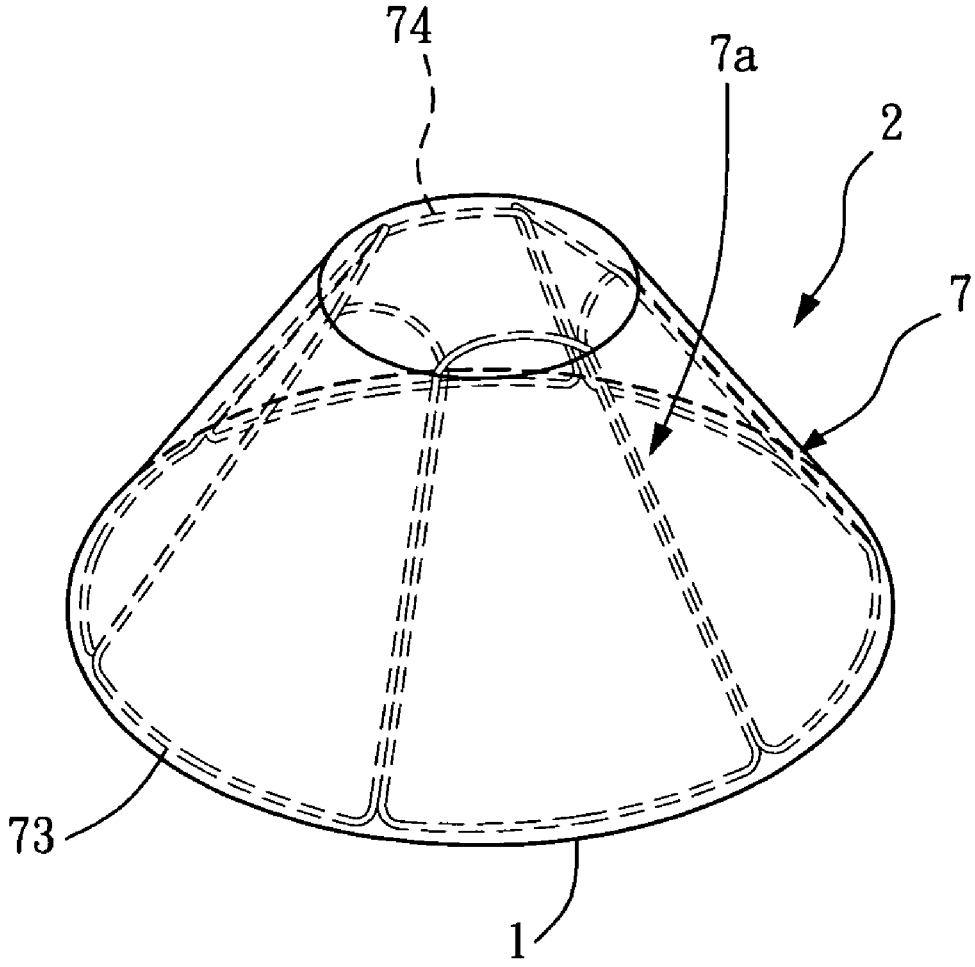
FIG. 9B is an assembly drawing of the disclosed foldable frame according to the eighth preferred embodiment of the present invention.
Figure 9C:
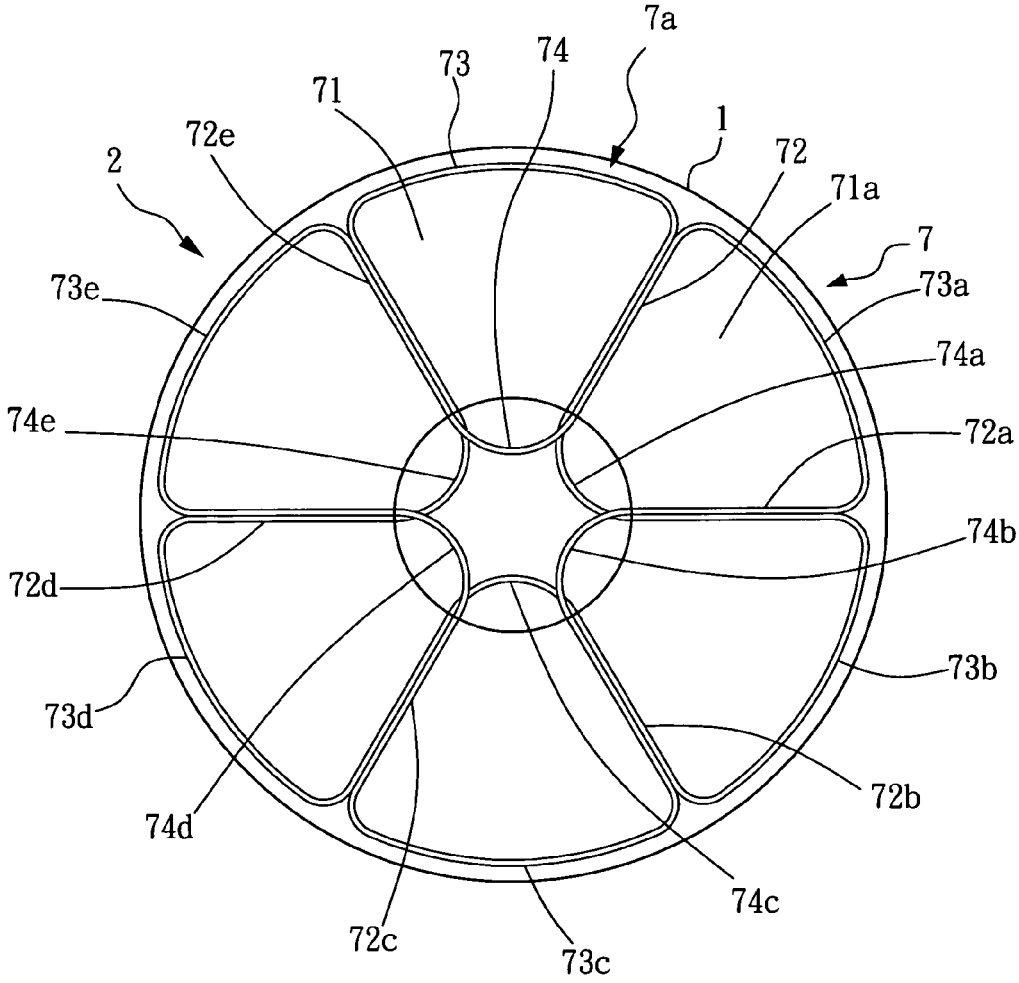
FIG. 9C is a front view of the disclosed foldable frame according to the eighth preferred embodiment of the present invention.
Figure 9D:
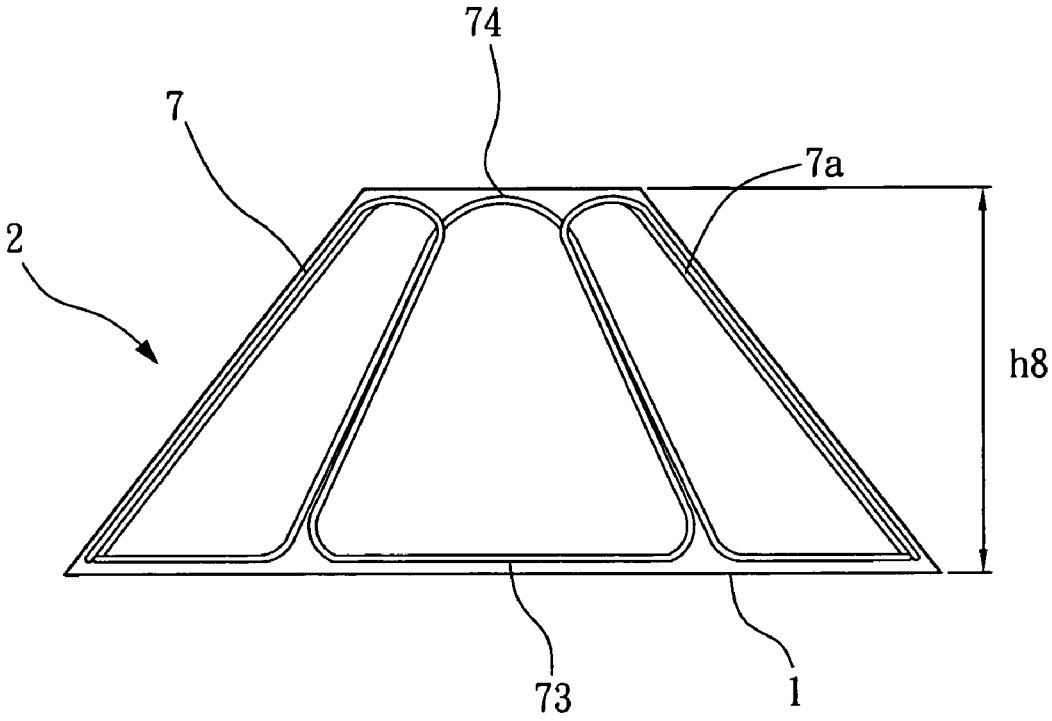
FIG. 9D is a top view of the disclosed foldable frame according to the eighth preferred embodiment of the present invention.

In the fourth embodiment of the present invention as illustrated through FIGS. 5A to 5C, the plurality of second overlapping ends 32 of the frame body 3*c* come into being the substantial apogees respectively and distant from the limit portion 1 with a height h4. To collapse the foldable frame structure of the present invention, firstly, a user may fold the 8-shaped parts at the plurality of first overlapping ends 31 along the direction perpendicular to the extended direction 94 so as to make the second overlapping ends 32 at the opposite sides of the 8-shaped parts become contacted with one another correspondingly, while the contacting ends 33 become closely contacted with one another correspondingly. Then the user can fold the folded 8-shaped parts along the extended direction 94 to make the plurality of first overlapping ends 31 contact one other correspondingly so that the plurality of cambered areas 34 can resultantly come into close contact with one another successively, whereby the frame can be collapsed for storage. Alternatively, the user can also fold the 8-shaped parts along the extended direction 94 at the plurality of first overlapping ends 31 firstly and then make the plurality of cambered areas 34 come into close contact with each other successively later to collapse the disclosed foldable frame structure.

Please refer to FIGS. 6A through 6D for the exploded view, assembly drawing, front view and top view of the disclosed foldable frame structure according to the fifth preferred embodiment of the present invention. The foldable frame structure of the present invention comprises a limit portion 1, a canopy portion 2, a first frame 41, as well as a second frame 42. The features of the limit portion 1 and the canopy portion 2 are substantially the same as those of the previously discussed embodiments and will not be discussed at any length herein. The first frame 41 is provided to enclose at least one cambered area, and comprises at least two first contacting ends 43. The first frame 41 is connected with the canopy portion 2 so as to lift the canopy portion 2 from the limit portion 1, while the first contacting ends 43 press against the limit portion 1. The second frame 42 comprises at least two second contacting ends 44 that press against the limit portion 1. After the second frame 42 and the first frame 41 are stacked together, a plurality of cambered areas 45, a plurality of first overlapping ends 46, and a plurality of second overlapping ends 47 can be formed. In the present embodiment, after the second frame 42 and the first frame 41 are stacked together, the resultant frame assembly appears as two 8-shaped parts that comprises four cambered areas 45, two first overlapping ends 46 and two second overlapping ends 47. The first overlapping ends 46 are aligned approximately along an extended direction 95. Each of the cambered areas 45 is simultaneously connected with another cambered area 45*c* at the first overlapping end 46, and connected with yet another cambered area 45*d* at the second overlapping end 47. In the present embodiment, the first frame 41 and the second frame 42 are made as an integrated piece and is made of an elastic material. Preferably, after the second frame 42 and the first frame 41 are stacked together, the resultant frame assembly comes to contain an even number of ranked 8-shaped parts. In virtue of the relative positional limit between the canopy portion 2 and the limit portion 1, and because the plurality of first contacting ends 43 and the plurality of second contacting ends 44 press against the limit portion 1 respectively, the plurality of first overlapping ends 46 can come into being the substantial apogees respectively and distant from the limit portion 1 with a height h5. Of course, it is also possible that the plurality of second overlapping ends 47 come into being the substantial apogees respectively and distant from the limit portion 1 with a height (not shown). To collapse the foldable frame structure of the present invention, firstly, a user may pile the plurality of first overlapping ends 46 mutually, and pile the plurality of second overlapping ends 47 mutually. Then the user can pile the plurality of first contacting ends 43 mutually and pile the plurality of second contacting ends 44 mutually to make the plurality of cambered areas 45 become closely contacted with one another successively, whereby the disclosed foldable frame structure can be collapsed for storage.

According to the present embodiment, the foldable frame structure may further comprise a combining portion 5*e*, which allows the first frame 41 and the second frame 42 to pass therethrough and be positioned with respect to the canopy portion 2 respectively. In the present embodiment, the combining portion 5*e* is sewed to the canopy portion 2 and formed as two hollow 8-shaped parts aligned along the extended direction 95. Alternatively, the combining portion 5*e* may be attached to the canopy portion 2 by applying an adhesive on the canopy portion 2, so that the first frame 41 and the second frame 42 can be bound to the canopy portion 2 by the means of adhesion.

Please refer to FIGS. 7A through 7D for the exploded view, assembly drawing, front view and top view of the disclosed foldable frame structure according to the sixth preferred embodiment of the present invention. The foldable frame structure of the present invention comprises a limit portion 1, a canopy portion 2, a first frame 41*a*, as well as a second frame 42*a*. The features of the limit portion 1 and the canopy portion 2 are substantially the same as those of the previously discussed embodiments and will not be discussed at any length herein. The first frame 41*a* comprises at least a third overlapping ends 48, wherein each third overlapping end 48 defines the first frame 41*a* as two cambered areas. In the present embodiment, the first frame 41*a* comprises four first contacting end 43*a*. The first frame 41*a* is connected with the canopy portion 2 so as to lift the canopy portion 2 from the limit portion 1, while the first contacting ends 43*a* press against the limit portion 1. Similarly, the second frame 42*a* comprises at least one fourth overlapping end 49, wherein each fourth overlapping end 49 defines the second frame 42*a* as two cambered areas. Also, the second frame 42*a* comprises four second contacting ends 44*a*. After the second frame 42*a* and first frame 41*a* are stacked together, a plurality of cambered areas 45*a*, a plurality of first overlapping ends 46*a*, and a plurality of second overlapping ends 47*a* can be formed. In the present embodiment, after the second frame 42*a* and the first frame 41*a* are stacked together, the resultant frame assembly contains four 8-shaped parts that comprises eight cambered areas 45*a*, four first overlapping ends 46*a* and four second overlapping ends 47*a*. The plurality of first overlapping ends 46*a* are aligned approximately along an extended direction 96. Each of the cambered areas 45*a* is simultaneously connected with another cambered area 45*e* at the first overlapping end 46*a* and connected with yet another cambered area 45*f* at the second overlapping end 47*a*. In virtue of the relative positional limit between the canopy portion 2 and the limit portion 1, and because the plurality of first contacting ends 43*a* and the plurality of second contacting ends 44*a* press against the limit portion 1 respectively, the plurality of first overlapping ends 46*a* can come into being the substantial apogees respectively and distant from the limit portion 1 with a height h6. Of course, it is also possible that the plurality of second overlapping ends 47*a* come into being the substantial apogees respectively and distant from the limit portion 1 with a height (not shown). To collapse the foldable frame structure of the present invention, firstly, a user may pile the plurality of first overlapping ends 46*a* mutually, and then pile the plurality of second overlapping ends 47*a*, the plurality of third overlapping ends 48, and the plurality of fourth overlapping ends 49 correspondingly. Afterward, the user can pile the plurality of first contacting end 43*a* and the plurality of second contacting ends 44*a* mutually to make the plurality of cambered areas 45 become contacted with one another successively, whereby the disclosed foldable frame structure can be collapsed for storage.

Please refer to FIGS. 8A through 8D for the exploded view, assembly drawing, front view and top view of the disclosed foldable frame structure according to the seventh preferred embodiment of the present invention. The foldable frame structure of the present invention comprises a limit portion 1, a canopy portion 2, and a plurality of frame bodies 6. The features of the limit portion 1 and the canopy portion 2 are substantially the same as those of the previously discussed embodiments and will not be discussed at any length herein. The plurality of frame bodies 6 are positioned inside the canopy portion 2 in a predetermined array. In the present embodiment, each said frame body 6 is an elastic component and composed of two ends joined together. Alternatively, each said frame body 6 may have an integrated structure. By twisting one of the contacting ends 63 of the frame body 6 circling a round cambered area for 180 degrees, an 8-shaped structure having an overlapping end 62 formed on the frame body 6 and two cambered areas 61 and 61*a* formed at the opposite sides of the overlapping end 62 can be accomplished. The frame body 6 further comprises two contacting ends 63 pressing against the periphery of the limit portion 1, so that the overlapping end 62 can come into being the substantial apogee and distant from the limit portion 1 with a height h7.

According to the present embodiment, the foldable frame structure may further comprise a combining portion 5*b*, which allows the frame body 6 to pass therethrough and be positioned with respect to the canopy portion 2. The combining portion 5*b* is settled on and parallel to the canopy portion 2. For facilitating lifting the canopy portion 2 over the limit portion 1, a flexible component (not shown) may be provided inside the combining portion 5*b*, and outside the frame body 6. Thereby, each of the frame body 6 can be positioned between each of the two combining portions 5*b*, and the plurality of frame bodies 6 can be aligned in the canopy portion 2 in a predetermined array. Moreover, each the frame body 6 can further comprise positioning component 68, which is an elastic component and can become deformed in response to an external force, and return to the original shape once the external force disappears. The positioning component 68 has at least two holes 681 so that when the positioning component 68 is installed at the overlapping end 62, the two holes 681 are both passed by one of the frame bodies 6 respectively and overlap mutually for connecting the two cambered areas 61 and 61*a*. If there is no combining portion 5*b* provided on the canopy portion 2, the plurality of frame bodies 6 can also be positioned and connected merely by piercing the frame body 6 and another frame body 6*a* through the two holes 681 respectively.

To collapse the foldable frame structure of the present invention, a user may firstly make the cambered area 61 of each frame body 6 come into close contact with the other cambered area 61*a* to cause the canopy portion 2 become folded along the direction perpendicular to the predetermined extended direction, so that the foldable frame structure can appear as a semi-elliptic structure. Then the user may further make the frame bodies 6 come into close contact with each other successively so that the canopy portion 2 can appear as being folded along the extended direction of the combining portion 5*b* whereby the disclosed foldable frame structure can be collapsed for storage. An alternative way to collapse the foldable frame structure of the present invention is to make the frame bodies 6 come into close contact with each other successively so that the canopy portion 2 can appear as being folded along the extended direction of the combining portion 5*b*. Then the use may fold the cambered area 61 of each frame body 6 onto the other cambered area 61*a* to make the canopy portion 2 fold along the direction perpendicular to the predetermined extended direction, whereby the disclosed foldable frame structure can be collapsed for storage.

Please refer to FIGS. 9A through 9D for the exploded view, assembly drawing, front view and top view of the disclosed foldable frame structure according to the eighth preferred embodiment of the present invention. The foldable frame structure of the present invention comprises a limit portion 1, a canopy portion 2, and at least one frame body 7. The features of the limit portion 1 and the canopy portion 2 are substantially the same as those of the previously discussed embodiments and will not be discussed at any length herein. The frame body 7 comprises a plurality of cambered areas 71 settled inside the canopy portion 2 in a radial array. Each said cambered area 71 is formed in an approximately triangular shape and is connected with another cambered area 71*a* at a first overlapping end 72, while also connected with the limit portion 1 at a contacting end 73, so the a pinnacle 74 can come into being the substantial apogee and distant from the limit portion 1 with a height h8.

According to the present invention, the foldable frame structure may further comprise a combining portion 5*c*, which allows the frame body 7 to pass therethrough and be positioned with respect to the canopy portion 2. In the present embodiment, the combining portion 5*c* is sewed to the canopy portion 2 and formed as a hexagon composed of six triangles. Thus, the frame body 7 has six overlapping ends 72, six contacting ends 73, and six pinnacles 74. For the purpose of illustration, the six overlapping ends 72 are sequentially defined as 72, 72*a*, 72*b*, 72*c*, 72*d*, and 72*e*. Meantime, the six contacting ends 73 are defined as 73, 73*a*, 73*b*, 73*c*, 73*d*, and 73*e* successively, while the six pinnacles 74 are defined as 74,

74*a*, 74*b*, 74*c*, 74*d*, and 74*e* successively. As the frame body 7 is made of the elastic material, it is capable of passing through the hollow part of the combining portion 5*c* in the order of 73*a*, 72*a*, 74*b*, 72*b*, 73*c*, 72*c*, 74*d*, 72*d*, 73*e*, 72*e*, 74, 72, and 73*a*; while another frame body 7*a* passes through 74*a*, 72*a*, 73*b*, 72*b*, 74*c*, 72*c*, 73*d*, 72*d*, 74*e*, 72*e*, 73, 72, and 74*a* sequentially. Alternatively, the combining portion 5*c* may be attached to the canopy portion 2 by applying an adhesive on the canopy portion 2, so that the frame body 7 can be bound to the canopy portion 2 by the means of adhesion.

The preferred embodiments of the invention have been disclosed above, which however should not be construed as a limitation on the actual application of the invention. Hence all modifications and alterations made by those familiar with the skill without departing from the spirits of the invention and appended claims shall remain within the protected scope of the invention.

What is claimed is:

1. A foldable frame structure, comprising:

a limit portion which is a bottom pad that can be placed at a plane;

a canopy portion, connected with the limit portion; and a frame body, which is positioned inside the canopy portion for lifting the canopy portion from the limit portion; the frame body is made of an elastic material and comprises a plurality of 8-shaped structures, wherein each 8-shaped structure has one first overlapping end, two cambered areas located at the opposite sides of the first overlapping end, and two contacting ends; in which the two contacting ends contact and press against the limit portion respectively so as to make the first overlapping end a substantial apogee and distant from the limit portion with a height;

wherein, each cambered area of the 8-shaped structure is connected with another neighboring cambered area of another 8-shaped structure by a second overlapping end; the plurality of first overlapping ends of the 8-shaped structures are aligned along an extended direction; in addition, by making the 8-shaped structures come into close contact with one another successively and making the cambered areas come into close contact with one another successively, the frame can be collapsed for storage;

wherein the frame body contains an odd number of 8-shaped structures that are ranked along the extended direction; in addition, the odd number of 8-shaped structures are formed by only one elastic material in an integrated manner.

2. The foldable frame structure of claim 1, wherein the frame body comprises three 8-shaped structures and thus has three first overlapping ends (31*a*), (31*b*) and (31*c*) sequentially along the extended direction (91), four second overlapping ends (32*a*), (32*b*), (32*c*) and (32*d*), and six contacting ends (33*a*), (33*b*), (33*c*), (33*d*), (33*e*), and (33*f*).

3. The foldable frame structure of claim 1, further comprising:

a plurality of positioning components, each said positioning component being an elastic component and having at least two holes; wherein the plurality of positioning components are positioned at the first and second overlapping ends for fixing neighboring cambered areas with each other.

4. A foldable frame structure, comprising:

a limit portion which is a bottom pad that can be placed at a plane;

a canopy portion, connected with the limit portion; and a frame body, which is positioned inside the canopy portion for lifting the canopy portion from the limit portion; the frame body is made of only one elastic material and comprises an odd number of 8-shaped structures, wherein each 8-shaped structure has one first overlapping end, two cambered areas located at the opposite sides of the first overlapping end, and two contacting ends; in which the two contacting ends contact and press against the limit portion respectively so as to make the first overlapping end a substantial apogee and distant from the limit portion with a height;

wherein, each cambered area of the 8-shaped structure is connected with another neighboring cambered area of another 8-shaped structure by a second overlapping end; the plurality of first overlapping ends of the 8-shaped structures are aligned along an extended direction; in addition, by making the 8-shaped structures come into close contact with one another successively and making the cambered areas come into close contact with one another successively, the frame can be collapsed for storage.

5. The foldable frame structure of claim 4, wherein the frame body comprises three 8-shaped structures and thus has three first overlapping ends (31*a*), (31*b*) and (31*c*) sequentially along the extended direction (91), four second overlapping ends (32*a*), (32*b*), (32*c*) and (32*d*), and six contacting ends (33*a*), (33*b*), (33*c*), (33*d*), (33*e*) and (33*f*).

* * * * *